US009995320B2

(12) United States Patent
Landberg

(10) Patent No.: US 9,995,320 B2
(45) Date of Patent: Jun. 12, 2018

(54) FLUID ACTUATOR ARRANGEMENT

(71) Applicant: SAAB AB, Linkoeping (SE)

(72) Inventor: Magnus Landberg, Linkoeping (SE)

(73) Assignee: SAAB AB, Linkoeping (SE)

( * ) Notice: Subject to any disclaimer, the term of this patent is extended or adjusted under 35 U.S.C. 154(b) by 0 days. days.

(21) Appl. No.: 15/524,513

(22) PCT Filed: Nov. 16, 2015

(86) PCT No.: PCT/SE2015/051229
§ 371 (c)(1),
(2) Date: May 4, 2017

(87) PCT Pub. No.: WO2016/080893
PCT Pub. Date: May 26, 2016

(65) Prior Publication Data

US 2017/0314581 A1 Nov. 2, 2017

(30) Foreign Application Priority Data

Nov. 19, 2014 (WO) ..... PCT/SE2014/051377

(51) Int. Cl.
*F15B 15/02* (2006.01)
*F15B 15/14* (2006.01)
*F15B 11/20* (2006.01)

(52) U.S. Cl.
CPC ..... *F15B 15/02* (2013.01); *F15B 11/20* (2013.01); *F15B 15/1409* (2013.01); *F15B 15/1428* (2013.01); *F15B 15/1447* (2013.01)

(58) Field of Classification Search
CPC ..... F15B 11/12; F15B 11/18; F15B 11/20; F15B 15/02; F15B 15/1409; F15B 15/1428; F15B 15/1447
See application file for complete search history.

(56) References Cited

U.S. PATENT DOCUMENTS 3,220,317 A 11/1965 Fuell
4,506,867 A 3/1985 LeGlue
(Continued)

FOREIGN PATENT DOCUMENTS

DE 2649958 A1 5/1978
DE 2818416 A1 11/1979
(Continued)

OTHER PUBLICATIONS

International Searching Authority, International Search Report and Written Opinion for International Application No. PCT/SE2015/051229, dated Feb. 8, 2016, 12 pages, Swedish Patent and Registration Office, Sweden.
(Continued)

*Primary Examiner* — Thomas E Lazo
(74) *Attorney, Agent, or Firm* — Alston & Bird LLP

(57) ABSTRACT

The present invention regards an elongated fluid actuator arrangement comprising a first and second cylinder housing (3, 5) extending in a longitudinal direction (X), respective housing (3, 5) encompasses a first respective a second piston body (7, 9). The respective piston body (7, 9) divides the respective cylinder housing (3, 5) in a first and second cylinder chamber (11, 13). The arrangement (1) is adapted for connection to a valve member means (15) of a fluid supply device (17). A piston rod member (19) extending through said respective first and second piston bodies (7, 9). The first piston device (7) comprises a piston rod engagement and disengagement means (29), which is adapted to engage or disengage the first piston device (7) to/from the piston rod member (19), wherein an engagement area (A2), defined by an engagement zone between the first piston body (7) and the piston rod member (19), is larger than a cross-sectional piston area (A1) of the first piston body (7).

23 Claims, 16 Drawing Sheets

(56) References Cited

U.S. PATENT DOCUMENTS

| | | | | | |
|---|---|---|---|---|---|
| 4,526,086 | A | * | 7/1985 | Holton | F15B 11/18 91/176 |
| 4,969,389 | A | * | 11/1990 | Foster | B65G 25/065 92/117 R |
| 5,361,680 | A | | 11/1994 | Matsui | |

FOREIGN PATENT DOCUMENTS

| | | | |
|---|---|---|---|
| DE | 3429492 | A1 | 2/1986 |
| DE | 3642695 | A1 | 6/1988 |
| DE | 4413165 | A1 | 10/1995 |
| DE | 102012007681 | A1 | 10/2013 |
| EP | 0814271 | A1 | 12/1997 |
| GB | 845150 | A | 8/1960 |
| JP | 58-5507 | A | 1/1983 |
| JP | 11-166506 | A | 6/1999 |
| JP | 2000-314405 | A | 11/2000 |
| SU | 993677 | A1 | 12/1983 |

OTHER PUBLICATIONS

International Searching Authority, International Search Report and Written Opinion for International Application No. PCT/SE2014/051377, dated Aug. 26, 2015, 11 pages, Swedish Patent and Registration Office, Sweden.

International Preliminary Examining Authority (IPEA), International Preliminary Report on Patentability, including Applicant's dated Dec. 13, 2016 Response to IPEA's Oct. 14, 2016 Written Opinion, for International Application No. PCT/SE2015/051229, dated Feb. 28, 2017, 19 pages, Swedish Patent and Registration Office, Sweden.

* cited by examiner

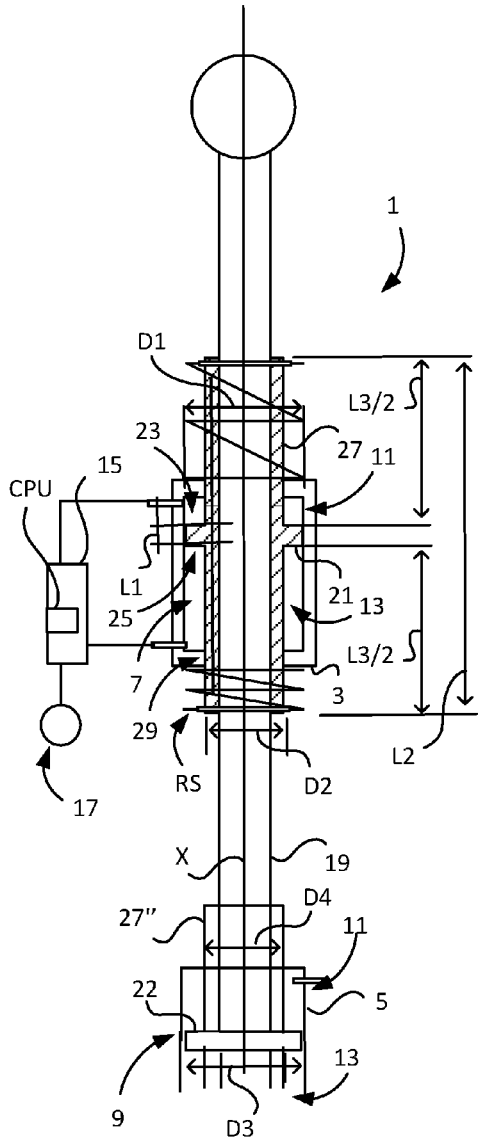
FIG. 1
FIG. 3
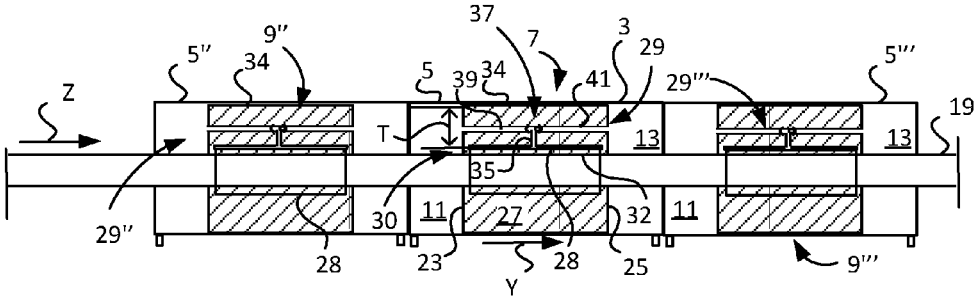

Fig. 12a
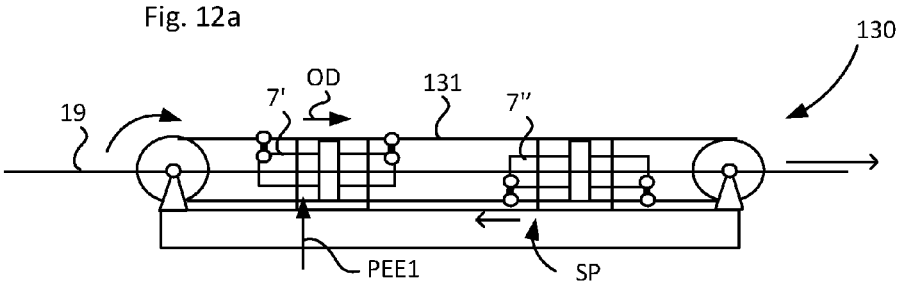
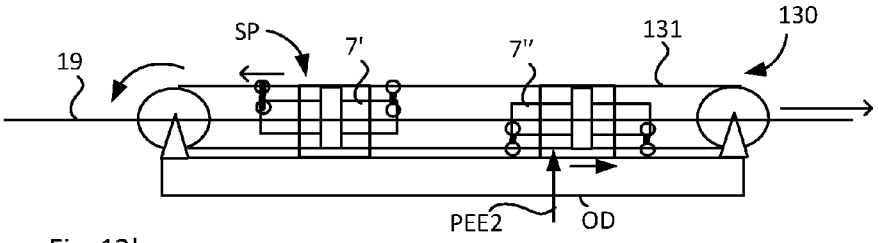
Fig. 12b
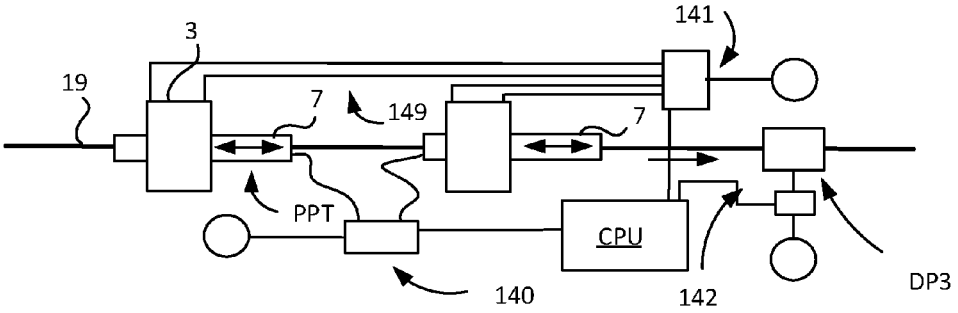
Fig. 13

FLUID ACTUATOR ARRANGEMENT

CROSS REFERENCE TO RELATED APPLICATIONS

This application is a National Stage Application, filed under 35 U.S.C. § 371, of International Application No. PCT/SE2015/051229, filed Nov. 16, 2015, which application claims priority to International Application No. PCT/SE2014/051377, filed Nov. 19, 2014; the contents of both of which as are hereby incorporated by reference herein, in their entirety.

BACKGROUND

Related Field

The present invention relates to an elongated fluid actuator arrangement according to the preamble of claim 1.

The present invention concerns the industry using hydraulic and/or pneumatic actuators for different types of applications and also concerns the manufacture industry producing such arrangements.

The invention is not limited thereto, but can also be used for replacing electrical actuator arrangements and can be adapted for application of a wide range of different types industries.

Description of Related Art

There is a desire to provide an elongated fluid actuator arrangement that reliably could distribute proper control functionality regarding force and motion rate of the piston rod member.

Current technology as published uses elongated fluid actuator arrangements that are designed with specific features for achieving desired pressure performance and pressure distribution for different motion rates and actuating forces. This may imply overweight and over-dimension materials.

Current technology also often uses a centrally controlled operation for controlling maximum motion rate and force of the piston rod member by means of regulating the fluid flow and pressure of the fluid supply device. Such centrally controlled feeding of fluid may make such arrangement ineffective.

U.S. Pat. No. 4,506,867 discloses a jacking apparatus for effecting motion of loads by means of two double-acting hydraulic cylinders for providing increased force of a power stroke. Hydraulic fluid pressure is controlled to a predetermined flow rate to the hydraulic cylinders for increasing the speed of a repositioning stroke of the apparatus.

U.S. Pat. No. 3,220,317 discloses a servo system having a hydraulic motor system with two pistons arranged in tandem for each motor. The system uses two motors connected in parallel so that their motions are in fixed proportions and their forces are added. The system may also be arranged with the motors in series so that forces are in fixed proportions and that motion is added.

BRIEF SUMMARY

An object of the present invention is to provide an elongated fluid actuator arrangement that performs a robust and reliable functionality even if there is variation in axial force acting upon the piston rod member and/or variation in time for engagement and disengagement of the fluid controlled membrane member.

An object of the present invention is to develop an energy saving elongated fluid actuator arrangement providing reliable functionality and/or providing actuator arrangements that can be applied to long distance and extended piston rod members. These are preferably put into use in e.g. lifts and high bay storage arrangements having extended and relatively long piston rods.

A further object is to increase energy efficiency of an elongated fluid actuator arrangement operating under various motion/movement and force performance selected from actual requirement or condition, without need of additional energy consuming throttling valves.

A yet further object is to provide an elongated fluid actuator arrangement exhibiting a lower weight compared with prior art fluid actuator arrangements.

An object is to improve current fluid actuator arrangements in mobile and industrial applications.

An object is to provide elongated fluid actuator arrangements to accomplish work with only minor amount of input force.

A yet further object is to minimize the environmental impact by lowering noise and reducing leaks.

One aspect is to provide an elongated fluid actuator arrangement that can be used in material handling equipment, agricultural equipment, vehicles, excavators, wellhead and jacking systems, construction equipment, hydraulic presses and others. A further aspect is to adapt the arrangement to 3D-printing in plastic, composite and/or metal applications for aircraft or automotive industry. A yet further aspect is to provide an arrangement that can be used in automated storage and retrieval systems for car parking and rough-terrain robots, so called legged robot systems. There is also an object to provide an elongated fluid actuator arrangement that can be used in military equipment utilizing hydraulic and/or pneumatic mechanisms. This includes armoured personnel carriers, aircraft material handlers, cranes and loaders, hook lifts, track adjusters and truck-mounted bridge layers etc.

At least one of said objects has been achieved by an elongated fluid actuator arrangement comprising: a first and second cylinder housing extending in a longitudinal direction, respective cylinder housing encompasses a first respective a second piston body; the respective piston body divides the respective cylinder housing in a first and second cylinder chamber; the arrangement being adapted for connection to a valve member means of a fluid supply device; a piston rod member extending through said respective first and second piston bodies; the first piston body comprises a piston rod engagement and disengagement means, which is adapted to engage or disengage the first piston body to/from the piston rod member, wherein an engagement area, defined by an engagement zone between the first piston body and the piston rod member, is larger than a cross-sectional piston area of the first piston body.

Preferably, a sensor device is arranged to the elongated fluid actuator arrangement for determining an actual cylinder-piston feature value, a control unit is associated with the sensor device and with the valve member means for controlling said engaging and disengaging of the piston body to/from the piston rod member.

Thereby is achieved that a monitoring and control of the first piston body motion in the first cylinder housing.

Thereby is achieved that monitoring and control of the second piston body motion in the second cylinder housing.

The engagement zone is defined as an engagement area corresponding with the contact and clamping area of the first piston body (or second piston body). I.e. the area of the piston body which is in engagement with the piston rod when the piston body is engaged. The measure of the engagement area e.g. has an extension corresponding with the radially inward projected extension of a cavity of the piston rod engagement and disengagement means. The cavity is co-axially arranged in the piston body and exhibits the same central axis as the cylinder housing and the piston rod member in the longitudinal direction. The cavity may be arranged for fluid communication with the respective first and second cylinder chamber.

Suitably, the piston rod engagement and disengagement means thus provides in engagement (clamping/gripping) sequence a secure hold of the piston rod by means of the control unit commanding the valve member to fed fluid with a first fluid pressure according to a pre-determined data scheme.

Preferably, the piston rod engagement and disengagement means thus provides in disengagement (release) sequence a release of the piston rod from the piston body by means of the control unit commanding the valve member to fed fluid with a second fluid pressure according to a pre-determined data scheme, wherein the second fluid pressure is low enough for said release, but high enough for making a retraction stroke.

Preferably, the cavity is arranged for fluid communication with a fluid supply via an exterior fluid port arranged on a first envelope surface of a first sleeve portion of the first piston body. The exterior fluid port is arranged on a segment of the first sleeve portion protruding from the first cylinder housing in the longitudinal direction.

Suitably, the cavity is arranged for fluid communication with a fluid supply via an exterior central fluid port arranged on the first cylinder housing. The piston rod engagement and disengagement means is adapted to be activated by said fluid supply device via the exterior central fluid port arranged on the first cylinder housing coupled to a longitudinal groove provided in an interface between the piston body and the cylinder housing interior, which longitudinal groove is in fluid communication with the piston rod engagement and disengagement means.

In such way is achieved that separate fluid transfer can be provided for a clamping action.

Preferably, the first piston body comprises a first sleeve portion and the first protruding portion.

Suitably, the first protruding portion protrudes from a first envelope surface of the first sleeve portion in a direction radially outward.

Thereby is achieved a piston body with a piston force area having an extension perpendicular to the longitudinal axis.

Preferably, the (respective first, second and/or third etc.) piston body comprises an elongated sleeve-shaped engagement and disengagement section (means) extending in the longitudinal direction, the engagement and disengagement section is arranged to engage and/or disengage with the piston rod member by means of a cavity that can be pressurized.

Suitably, the cavity is arranged within the elongated sleeve-shaped engagement and disengagement section which is oriented co-axially with the section.

Preferably, the cavity extends more than half the length of the elongated sleeve-shaped engagement and disengagement section in the longitudinal direction.

Suitably, the cavity extends less than 99% of the length of the elongated sleeve-shaped engagement and disengagement section in the longitudinal direction.

In such way is provided a reliable engagement of the elongated sleeve-shaped engagement and disengagement section to the piston rod member.

Preferably, the extension of the cavity in the longitudinal direction is 70-90% of the length of the sleeve-shaped engagement and disengagement section.

Suitably, the sleeve-shaped engagement and disengagement section exhibits outer envelope surfaces which are slidingly arranged through end cap bores of a cylinder housing.

Preferably, a protruding portion which protrudes from the outer envelope surfaces and in a direction radially outward towards and in contact with an inner sliding surface of the cylinder housing.

Suitably, the protruding portion exhibits opposite piston force areas.

Preferably, the opposite piston force areas exhibit an extension that is transverse to the longitudinal direction.

Thereby is provided that the first piston body, when pressurizing the first cylinder chamber with a first pressure, will be engaged and clamped (locked) to the piston rod member by means of the piston rod engagement and disengagement means being actuated by said first pressure. Disengagement of the first piston device from the piston rod member will be provided when the first cylinder chamber is pressurized with a second pressure or not being pressurized.

Thereby is achieved an arrangement that is robust and that will function in a reliable way.

Suitably, the first piston body comprises a first protruding portion protruding in a direction radially outward with a first cross-sectional (transverse to the longitudinal direction) measure and defining opposite cross-sectional piston areas. The piston body exhibits a first length in said longitudinal direction. A first sleeve portion exhibits a smaller second measure in cross-section than the first measure. The first sleeve portion defines an additional measure to the first length defining a second length in said longitudinal direction. The first sleeve portion comprises a piston rod engagement and disengagement means adapted to be operated by a fluid supply device.

According to one aspect of the invention, the arrangement is preferably made as compact as possible, wherein the piston body exhibits the above-mentioned first length. An engagement area of a through bore (extending in said longitudinal direction and centrally of the piston body) of a piston body requires some kind of strengthening of the engagement between the piston body and the piston rod member. By forming the piston body with a sleeve portion extending in the longitudinal direction from the protruding portion, the engagement area will be sufficient large for rigid engagement to the piston rod.

Preferably, the protruding portion comprises an outer sliding surface arranged for sliding in the cylinder housing for sliding contact with the cylinder housing wall. The protruding portion is also arranged with the opposite piston areas, which areas extend in transverse direction to the longitudinal direction.

Suitably, the length of the sleeve portion determines the extension of the engagement area of the piston engagement and disengagement means (such as a membrane member) arranged within the sleeve portion and/or piston body. The membrane member is provided for engagement and disengagement (e.g. by engaging an inner surface of the sleeve portion) of the piston body to the piston rod member. This can be made by pressurizing the piston rod engagement and disengagement means (e.g. the membrane member).

Preferably, the engagement area A2 is larger than the cross-sectional (effective) piston area A1. By experiments made by the applicant there has been shown that by such relation, the engagement is optimal between the piston rod and the piston body.

Thus, according to one aspect

A2>A1

According to another aspect

A2>2*A1

According to yet a further aspect

A2>10*A1 up to 12 to 15*A1

According to one aspect

A2>15 to 25*A1 or larger

Thereby is achieved a clamping of the piston body to the piston rod member by means of a fluid pressure in a membrane cavity of the membrane member that is the same pressure that acts upon the cross-sectional piston area, without any need of additional pressure strengthening device applied to the membrane member.

Suitably, the piston rod engagement and disengagement means is adapted to be operated by said fluid supply device via said cylinder chambers.

Alternatively, the operation of the piston rod engagement and disengagement means is provided by pressurization of the respective cylinder chamber by means of the control unit controlling the valve member means.

Preferably, the piston rod engagement and disengagement means comprises a cavity in the first sleeve portion forming a membrane member, which cavity is arranged for fluid communication with respective cylinder chamber.

Suitably, the membrane member is formed by an inner sleeve surrounded by an outer housing coaxially arranged around the inner sleeve with a distance forming the cavity. Preferably, the cavity (or at least two cavities) thus being formed between an outer surface of the inner sleeve and an inner surface of the surrounding outer housing. The inner sleeve is made flexible and comprises e.g. bronze-based material or other suitable flexible materials. The bronze-based material also exhibits low frictional coefficient.

Suitably, the inner sleeve comprises a material that provides both flexibility (for optimal clamping properties) and low frictional coefficient.

Preferably, the open ends of the outer housing is covered by a respective support ring for fixation of the inner sleeve within the outer housing. Seals or O-rings are arranged in end positions of the membrane between the outer surface of the inner sleeve and the inner surface of the outer housing for providing a seal between the inner sleeve and the outer housing.

Alternatively, a main fluid passage is arranged for fluid communication with the piston rod engagement and disengagement means and joins a branch junction diverging into a first and second passage to the respective cylinder chamber.

Suitably, at least the first fluid passage enters at the cross-sectional piston area of the first cylinder chamber.

Alternatively, at least the second fluid passage enters at the cross-sectional piston area of the second cylinder chamber.

Preferably, the protruding body portion and the sleeve portion are made in one piece.

Thereby is achieved reliable operation and cost-effective production of the arrangement.

Suitably, the second piston body comprises a second piston rod engagement and disengagement means.

Preferably, the second piston body comprises a second protruding body portion having a third measure and a second sleeve portion having a smaller fourth cross-sectional (transverse to the longitudinal direction) measure than the third measure.

Suitably, the first measure corresponds with the third measure.

Preferably, the second length is larger than the cylinder housing length in said longitudinal direction.

In such way a relatively low pressure can be used for operation of the elongated fluid actuator arrangement by means of providing a relatively large engagement area (in relation to the cross-sectional piston area) of the membrane member.

Suitably, a third cylinder housing encompassing a third piston body is arranged to said piston rod member, the third piston body comprises a third piston rod engagement and disengagement means.

Preferably, a first cross-sectional piston area of the first piston body differs in measure from a second cross-sectional piston area of the second piston body.

There is thus possible to control the elongated fluid actuator arrangement performance by altering the arrangement's effective force area (cross-sectional piston area) during operation. This introduces a new level of energy efficiency to hydraulic and/or pneumatic systems used in power transmissions.

Suitably, the arrangement comprises a first actuator provided with a first cross-sectional piston area, a second actuator provided with a second cross-sectional piston area corresponding with the first cross-sectional piston area, a third actuator provided with a third cross-sectional piston area, a fourth actuator provided with a fourth cross-sectional piston area, the third cross-sectional piston area is twice as large as the first cross-sectional piston area, the fourth cross-sectional piston area is twice as large as the third cross-sectional piston area.

Preferably, the valve member means of the fluid supply device is associated with a control unit.

Suitably, the membrane member comprises a plurality of cavities.

Preferably, the membrane member comprises a cavity gap or slot, which extends over nearly the total second length of the sleeve portion and/or circumferentially (co-axially) adjacent the inner surface of the sleeve portion. The cavity is connected to a passage arrangement, which has an entrance opening (fluid port) or several openings arranged in communication with the cylinder housing interior (first cylinder chamber and second cylinder chamber).

Suitably, the cavity gap or slot (or a plurality of gaps) co-axially follows the circumferential perimeter of the sleeve portion, seen in cross-sectional view, at a pre-determined distance from the inner surface (engagement surface) of the sleeve portion.

Preferably, the cavity gap is connected to a fluid passage, which has a fluid port or several openings being in communication with the interior of the cylinder housing (i.e. with both or one of the first and second cylinder chamber).

In such way is achieved that the pressure in the pressurized cylinder chamber is the same as the pressure of the pressurized membrane member.

Suitably, the protruding portion divides the cylinder housing in said first and second cylinder chamber.

By pressurizing the first chamber, the pressurized fluid will entry the fluid port (e.g. arranged at the pressure area of the piston body facing the first cylinder chamber or at other surface portion of the piston body facing the first cylinder chamber) and pressurizing the cavity of the piston rod engagement and disengagement means (membrane member). The pressurizing of the membrane member will provide an expansion of the inner surface of the sleeve portion in a direction radially inward. The piston body will thereby be clamped to the piston rod member by the engagement of the inner surface to the piston rod member.

Suitably, the sleeve portion exhibits a material thickness defined between the cavity and an outer perimeter surface of the sleeve portion that is larger than the thickness defined between the cavity and the inner surface of the sleeve portion. This implies that no expansion of the outer surface is made during said pressurization of the membrane member. This embodiment is suitable when the sleeve portion extends from both exterior ends of the cylinder housing. This provides tight sealing between cylinder housing and the piston body during operation. The inner surface of the sleeve portion is in engagement with the piston rod member in the engagement state by means of the pressurized cavity gap of the membrane member pressing the inner surface towards the piston rod member.

The membrane member cavity is preferably positioned one sixth to one third of the thickness of sleeve portion material seen in radial direction and in direction from the inner surface.

Suitably, the thickness of material is selected from the expected engagement force thereby providing strength to the piston body and preventing that said outer surface expansion occurs and also selected from maximal axial force acting upon the piston body.

Suitably, the sleeve portion is partly exposed outside the cylinder housing.

This implies that efficient detection (by human eye or other by other suitable way to determine the position of the exposed sleeve portion outside the cylinder housing) of the position of the piston body relative the cylinder housing will be possible.

By alternate controlling the motion (and engagement/disengagement) of the respective first and second piston body, the piston rod can be propelled a considerable distance (extremely long stroke performance) and alternatively with different forces. The alternate controlling of the motion is performed by proper actuating of the valve member means.

Preferably, the area of the membrane member is 5 to 30, preferably 10 to 20, times larger than the cross-sectional (effective) piston area.

By using a relatively large engagement and disengagement means (membrane member) area in relation to the piston area, the engagement of the piston body to the piston rod member is rigid. The axial pressure/force acting on the piston body (piston area), by means of the pressurized fluid in the cylinder chamber, provides a certain load to the piston body. The clamping force (engagement of the piston body to the piston rod member) or engaging force provides clamping (engagement) of the piston body to the piston rod member. The engaging force provides sufficient friction fixing the piston body in position to the piston rod, wherein the engagement force prevails over the axial force.

Such relatively large engagement area of the piston rod engagement and disengagement means implies that low fluid pressure can be used.

Preferably, the arrangement is used for hydraulic application and the hydraulic pressure used is between 100 to 300 bar, preferably 200 to 250 bar depending on application.

In such way fatigue failure (fracture) or other damage of the membrane can be avoided.

Suitably, the hydraulic pressure is up to 450 bar.

Hence, service cost and manufacture cost could be reduced as conventional material can be used to a greater extent.

Thereby is achieved quick engagement and disengagement of the piston body to the piston rod.

This is made by direct fluid communication between the pressurized cylinder chamber and the membrane member cavity.

Preferably, the piston body comprises a first passage arrangement adapted for fluid communication with said cavity gap.

Suitably, a shuttle valve is arranged in said first piston device and is adapted for direct fluid communication with said first cavity and said first and second cylinder chamber of the first cylinder. The basic structure of a shuttle valve is like a cavity having e.g. three openings, one on each end and one in the middle. A ball or other blocking valve element moves freely within the cavity. When pressure from a fluid is exerted through one end opening it pushes the ball towards the opposite end. This prevents the fluid from traveling through that opposite end opening, but allows it to flow through the middle opening. In this way two different sources can provide fluid pressure to a common membrane member without any back flow from cylinder chamber to the other.

In such way is achieved that the cylinder chamber having the highest pressure (and thereby propelling the piston body) will provide the membrane member cavity with the same pressure as in the pressurized cylinder chamber. The membrane member will thus be pressurized (expanding the inner surface of the piston body) and provides engagement of the piston body to the piston rod, wherein the piston body manage propel the piston rod.

Preferably, the shuttle valve is arranged in a passage line arrangement of the protruding portion.

By means of the passage arrangement providing a direct fluid communication between the pressurized cylinder chamber and the membrane member a reliable operation of the elongated fluid actuator arrangement is achieved.

Thereby the risk for fluid leakage, jamming, operational stop etc. is more or less eliminated.

Alternatively, the passage arrangement comprises a main passage in one direction joining the membrane member cavity and in the other direction joins e.g. a T-junction (including the shuttle valve) diverging into a first and second fluid line each connected to the respective cylinder chamber.

Suitably, the first fluid line of the protruding portion comprises an inflow port on the first cross-sectional piston area and the second fluid line of the protruding portion comprises an inflow port on the second cross-sectional piston area.

Preferably, a returning arrangement is provided for returning at least one piston body to a starting point relatively its cylinder housing, in which starting point the piston body is engaged to the piston rod for propelling the piston rod.

Preferably, the returning is provided by the fluid supply and valve member means controlled by the control unit.

Suitably, said returning arrangement is coupled to at least two co-acting piston bodies for mutually returning respective piston body to its starting point after fulfilled piston stroke.

Preferably, a resetting spring (e.g. a compression spring) arrangement is mounted to the exterior of the cylinder housing and to the piston body, thereby acting as said returning arrangement.

Suitably, the returning arrangement comprises a chain wheel device including a chain arrangement mounted in engagement with respective first and second piston body in such way that when the first piston body is propelled in one direction, the second piston body is returned to its starting point and when the second piston body is propelled in said one direction, the first piston body is returned to its starting point.

Preferably, the returning arrangement comprises a reverse motion linkage arrangement provided for moving the first piston body in one direction when the second piston body is moved in the opposite direction and vice versa.

Suitably, the reverse motion linkage arrangement comprises a flexible member for compensating shifting momentum from propelling the first piston body to propelling the second piston body. The shifting momentum is due when both piston bodies, or more than two piston bodies, are engaged with the piston rod at the same time and may be provided during a very short time period, such as 1-10 milliseconds or more.

In such way is achieved cost-effective service and proper visual status detection of the resetting springs.

The sleeve portion can be called "block portion", "engaging portion", "extended clamping portion" of the piston body or other suitable term.

The respective first, second, third and fourth piston body being parts of a first, second, third and fourth actuator means.

Preferably, the piston rod engagement and disengagement means is adapted to be activated by said fluid supply device via a fluid connection arranged on a sleeve portion of the respective piston body outside the cylinder housing.

In such way is achieved that direct fluid transfer for a clamping action is provided.

Suitably, the piston rod engagement and disengagement means is adapted to be activated by said fluid supply device via a fluid connection arranged on the cylinder housing coupled to a longitudinal groove in an interface between the piston body and the cylinder housing interior, which groove is in fluid communication with the piston rod engagement and disengagement means.

In such way is achieved that separate fluid transfer can be provided for a clamping action.

Preferably, the sensor device is arranged to the elongated fluid actuator arrangement for determining an actual cylinder-piston feature value, a control unit is associated with the sensor device and with the valve member means for controlling said engaging and disengaging of the piston body to/from the piston rod member.

Thereby is achieved that a monitoring and control of the first piston body motion in the first cylinder housing.

Thereby is achieved that monitoring and control of the second piston body motion in the second cylinder housing.

Suitably, a sensor device is arranged to the elongated fluid actuator arrangement for determining a piston rod member position value, a control unit is associated with the sensor device and with the valve member means for controlling said engaging and disengaging of the piston body to/from the piston rod member.

In such way is achieved that that the position of the piston rod member can be determined in an effective way independently from the actual cylinder-piston feature value or in combination with the actual cylinder-piston feature value.

Preferably, the sensor device comprises a linear potentiometer.

Suitably, the sensor device comprises an optical detector.

Preferably, the sensor device comprises an angular potentiometer.

Suitably, the sensor device comprises a pressure sensor.

Preferably, the control unit is adapted to control the valve member means from a desired cylinder-piston feature value in regard to said determined actual cylinder-piston feature value and/or said piston rod member position value, for regulating fluid flow fed from the fluid supply device to the respective first and second cylinder chamber.

In such way is achieved that efficient control of the arrangement is achieved. Thereby is also achieved that the control unit can be used to operate the arrangement in many various ways in regard to actual operation and mode.

This is also solved by a method for controlling the motion of an elongated fluid actuator arrangement including a first cylinder housing encompassing a first piston body comprising a first piston rod engagement and disengagement means and dividing the first cylinder housing in a first and second cylinder chamber coupled to a fluid supply via a valve member means, a control unit is associated with a sensor device of the arrangement for determining an actual cylinder-piston feature value and is coupled to said valve member means for regulating fluid flow to said first cylinder housing, a piston rod extends through the first piston body, the method comprises the steps of; providing a first actual cylinder-piston feature value to the control unit; comparing the first actual cylinder-piston feature value with a first desired cylinder-piston feature value; regulating fluid flow to the respective first and second cylinder chamber; and repeating the preceding steps until the first actual cylinder-piston feature value corresponds with the first desired cylinder-piston feature value.

In such way is achieved a precise and smooth motion of the piston rod member and adaptability of the arrangement to different loads and working conditions.

Preferably, the arrangement further comprises a second cylinder housing encompassing a second piston body comprising a second piston rod engagement and disengagement means and dividing the second cylinder housing in a first and second cylinder chamber coupled to a fluid supply via a valve member means, a control unit is associated with a sensor device of the arrangement for determining an actual cylinder-piston feature value and is coupled to said valve member means for regulating fluid flow to said second cylinder housing (5), a piston rod extends through the second piston body, the method comprises the steps of; pressurizing the first cylinder chamber of the first cylinder housing with a first fluid pressure feature for engaging the first piston rod engagement and disengagement means to the piston rod and driving the first piston body with the piston rod from a first start position to a first end position; pressurizing the second cylinder housing of the second cylinder housing with a second fluid pressure feature for disengaging the second piston rod engagement and disengagement means from the piston rod and retracting the second piston body to a second start position; pressurizing the first cylinder chamber of the second cylinder housing with the first fluid pressure feature for engaging the second piston rod engagement and disengagement means to the piston rod and driving the second piston body with the piston rod from the second start position to a second end position; wherein said valve member means is controlled to manage the second start position to precede said first end position with an overlap time interval.

Thereby is achieved that a smooth performance and motion of the piston rod member can be made.

Preferably, the time for retraction of the second piston body is shorter than the time for the working stroke of the first piston body from the first start position to the first end position.

BRIEF DESCRIPTION OF THE FIGURES

The present invention will now be described by way of examples with references to the accompanying schematic drawings, of which:

FIG. 1 illustrates one aspect of the present invention;

FIG. 3 illustrates a further aspect of the invention;

FIGS. 12*a* to 12*b* illustrate yet a further aspect;

FIG. 13 illustrates an arrangement having separate fluid supply systems;

DETAILED DESCRIPTION OF VARIOUS EMBODIMENTS

Figure 2A:
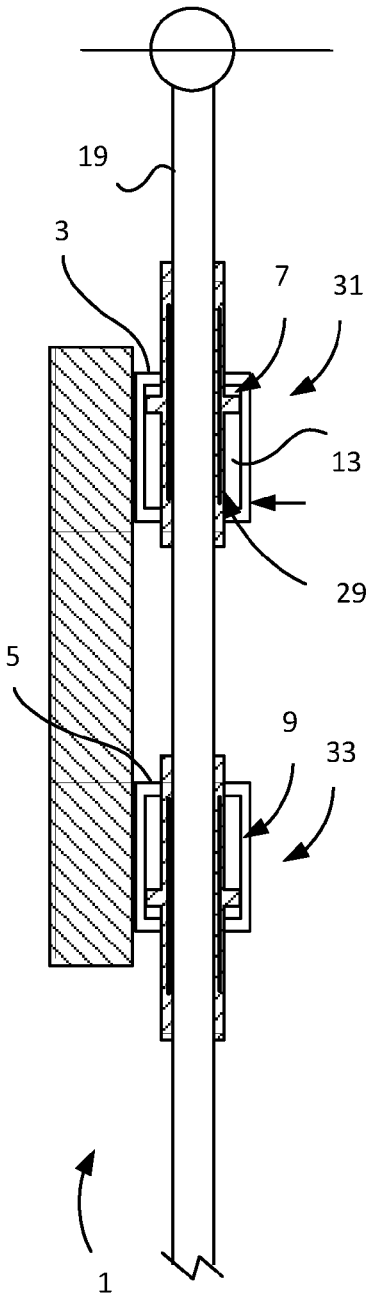
FIGS. 2*a* to 2*b* illustrate the arrangement in FIG. 1 in operation.

Hereinafter, embodiments of the present invention will be described in detail with reference to the accompanying drawings, wherein for the sake of clarity and understanding of the invention some details of no importance may be deleted from the drawings. The elongated fluid actuator arrangement 1 is herein also called arrangement.

FIG. 1 schematically shows an elongated fluid actuator arrangement 1 comprising a first and second cylinder housing 3, 5 extending in a longitudinal direction X, respective cylinder housing 3, 5 encompasses a first 7 respective a second 9 piston body. The respective piston body 7, 9 divides the respective cylinder housing 3, 5 in a first 11 and second 13 cylinder chamber. The arrangement is adapted for connection to a valve member means 15 of a fluid supply device 17. A control unit CPU is arranged for controlling the valve member means 15. A piston rod 19 extends through the respective first 7 and second 9 piston bodies. The first piston body 7 comprises a first protruding portion 21 protruding in a direction radially outward and transverse to the longitudinal direction X. The first protruding portion 21 exhibits a first diameter D1. Opposite cross-sectional piston areas 23, 25 are formed by plane surfaces of the first protruding portion 21 extending transverse to the longitudinal direction X. The first protruding portion 21 exhibits a first length L1 in the longitudinal direction. The first piston body 7 comprises a first sleeve portion 27 having a second diameter D2, which is smaller in amount than the first diameter D1, seen in cross-section. The first sleeve portion 27 exhibits a second length L2. The second length L2 comprises the first length L1 and exhibits an additional measure L3 (L3/2+L3/2) according to the formula L2=L1+L3. The first sleeve portion 27 comprises a piston rod engagement and disengagement means 29 adapted to be operated by said fluid supply device 17 via said cylinder chambers 11, 13, which are provided for fluid communication to a membrane cavity (see e.g. ref. 28 in FIG. 5*a*) formed in the first sleeve portion 27 and constituting part of the piston rod engagement and disengagement means 29. A resetting (returning) spring RS (e.g. a compression spring) arrangement is provided to the exterior of the cylinder housing 3 with one end and to the first piston body 7 with the other end. The second piston body 9 comprises a second protruding body portion 22 having a third diameter D3 and a second sleeve portion 27" having a smaller fourth measure D4. The first diameter D1 corresponds with the third diameter D3.

Figure 2B:
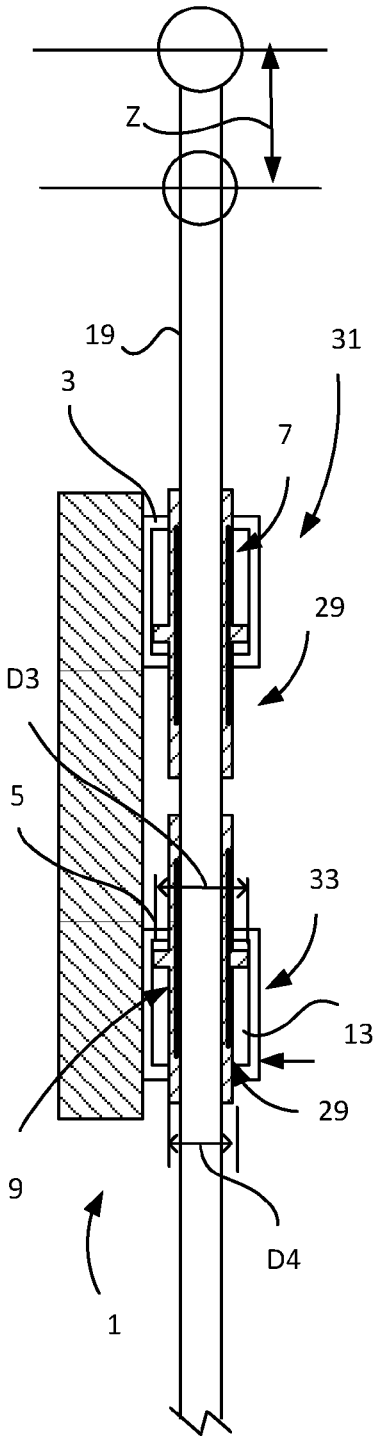

FIGS. 2*a* to 2*b* schematically show an upper 31 and lower 33 actuator of an arrangement 1 in operation. The arrangement 1 comprises a pair of rigidly fixed cylinder housings 3, 5 of respective actuator 31, 33. FIG. 2*a* shows that the first piston body 7 of the upper actuator 31 is actuated by pressurizing the second cylinder chamber 13, wherein the piston rod engagement and disengagement means 29 engages the first piston body 7 to the piston rod 19 for propelling the latter in a direction upward. In FIG. 2*b* is shown that the second cylinder chamber 13 of the lower actuator 33 is pressurized propelling the second piston body 9 upwardly. No pressure is applied to the upper actuator 31, wherein the first piston body 7 of the upper actuator 31 being released from the piston rod 19 by the inactive (not pressurized) piston rod engagement and disengagement means 29 of the first piston body 7. The piston rod 19 has been propelled a distance Z in FIG. 2*b*. The operation proceeds in a smooth and continuous manner with repeated steps until the arrangement is controlled to stop.

FIG. 3 illustrates a further aspect of the invention. A piston rod engagement and disengagement means 29 of the arrangement 1 comprises a cavity 28 in the sleeve portion 27 and forming a membrane 30 positioned adjacent an inner surface 32 of the sleeve portion 27. The cavity 28 is arranged for fluid communication with respective cylinder chamber 11, 13 of a first cylinder housing 3. The arrangement 1 further comprises a second and a third cylinder housing 5", 5'" and therein arranged second and third piston body 9", 9'". The third cylinder housing 5'" thus encompasses the third piston body 9'" being arranged to a common piston rod member 19. The second piston body 9" comprises a second piston rod engagement and disengagement means 29" and the third piston body 9'" comprises a third piston rod engagement and disengagement means 29".

A main fluid passage 35 is arranged for fluid communication with the cavity 28 and joins a branch junction 37 diverging into a first 39 and second 41 passage arranged for fluid communication with the respective cylinder chamber 11, 13. The respective first and second passage 39, 41 ends at respective piston area 23, 25 at fluid ports facing the cylinder chambers 11, 13. The first fluid passage 39 thus enters at the cross-sectional piston area 23 of the first cylinder chamber 11. By pressurizing the cavity 28 of the engagement and disengagement means (comprising the membrane member 30) the latter will provide an expansion of the inner surface 32 of the sleeve portion 27 in a direction radially inward. The piston body 7 will thereby be clamped to the piston rod 19. The thickness T of the piston material, which thickness is defined between the cavity 28 and an outer surface 34 of the sleeve portion 27 exhibits such measure that no expansion of the outer surface 34 is performed during said pressurization of the membrane member 30. At the same time, by said pressurizing, the piston body is forced to move in direction Y. By said engagement of the piston body 7 to the piston rod 17, the latter will be propelled in direction Z.

Figure 4A:
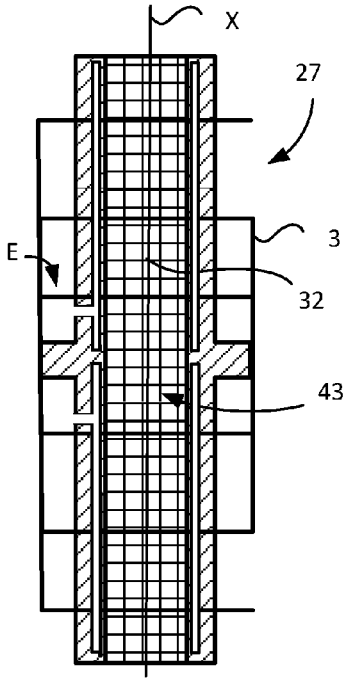
FIGS. 4*a* to 4*b* illustrate further aspects of the invention.
Figure 4B:
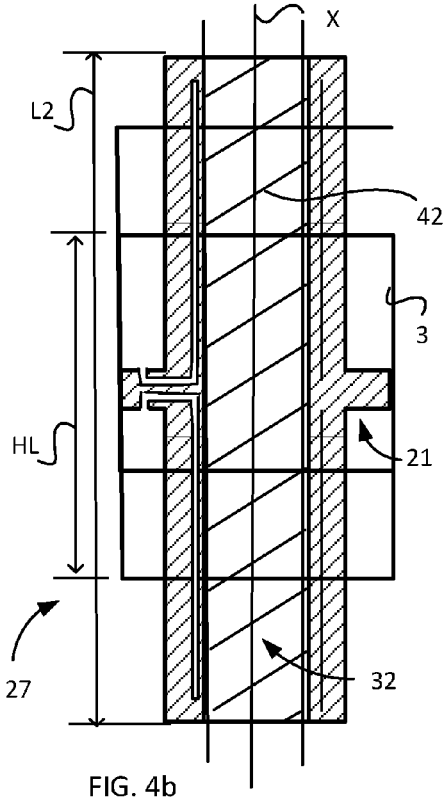

FIGS. 4*a* to 4*b* illustrate further aspects of the invention. FIG. 4*a* illustrates a sleeve portion 27 having an inner surface 32 comprising grooves in a gridiron pattern 43 for enhanced engagement performance. End stroke position is marked with E. FIG. 4*b* illustrates a sleeve portion 27 having an inner surface 32 comprising grooves in helical pattern 42 for enhanced engagement performance. The protruding body portion 21 and the sleeve portion 27 are made in one piece. The second length L2 is larger than the cylinder housing 3 length HL in said longitudinal direction X.

Figure 5A:
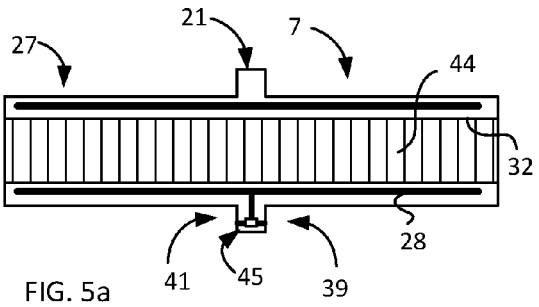
FIGS. 5*a* to 5*d* illustrate further aspects of the invention.

FIGS. 5*a* to 5*d* illustrate further aspects of the invention. FIG. 5*a* illustrates a cross section of a sleeve portion 27 in longitudinal direction. The inner surface 32 of the sleeve portion 27 is provided with transversal grooves 44. Passages 39, 41 provide fluid communication between the cylinder chambers (not shown) and a membrane cavity 28 via a shuttle valve 45, which shuttle valve 45 is shown in an enlarged view in FIG. 5*b*.

Figure 5C:
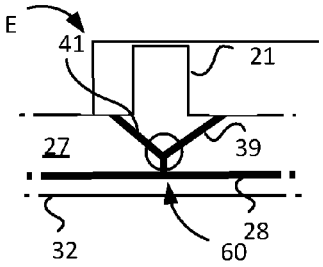
Figure 5B:
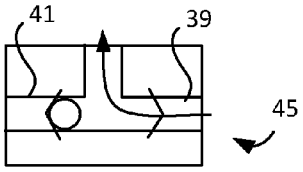
Figure 5D:
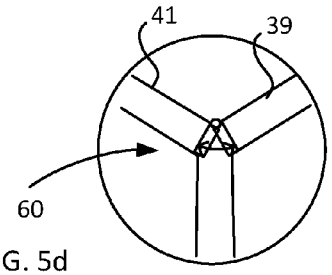

FIG. 5*c* illustrates a flap valve 60 arranged for proper distribution of pressurized fluid from the respective cylinder chamber to the cavity 28 depending upon which cylinder chamber being pressurized. FIG. 5*d* illustrates an enlarged view of the flap valve 60 in FIG. 5*c*.

Figure 6A:
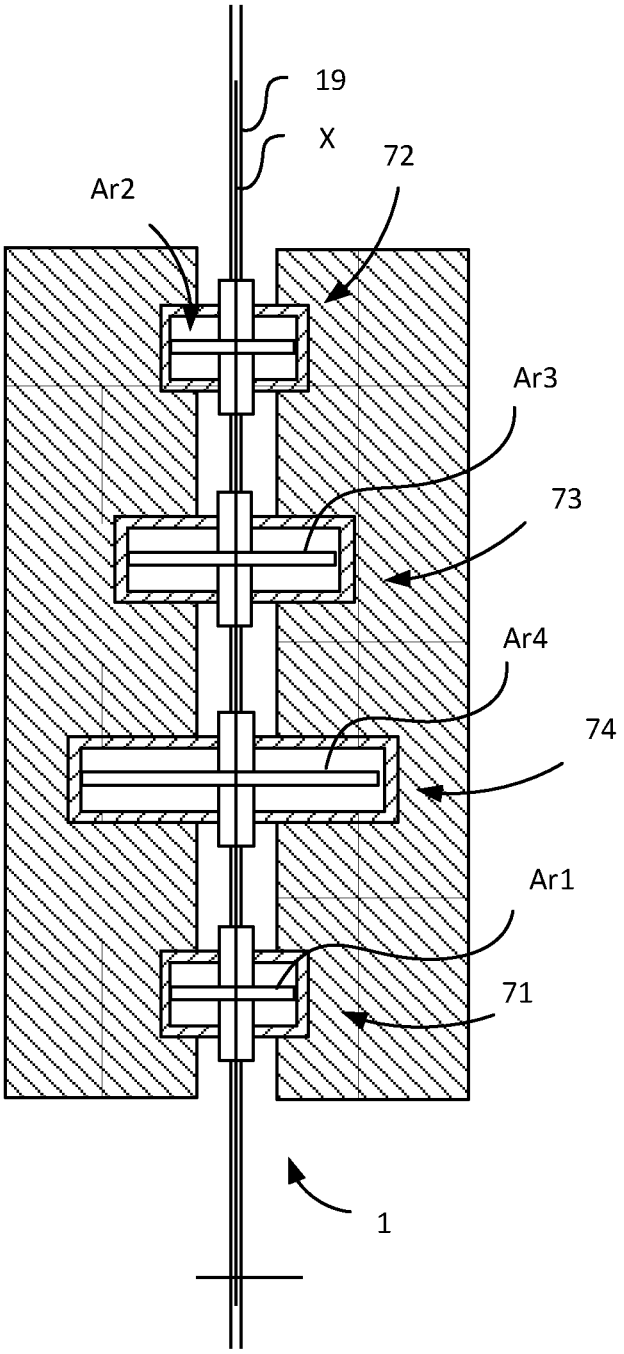
FIGS. 6*a* to 6*b* illustrate a yet further aspects of the present invention.

FIG. 6*a* illustrates a yet further aspect of the present invention. The arrangement 1 comprises a first actuator 71 provided with a first cross-sectional piston area Ar1, a second actuator 72 provided with a second cross-sectional piston area Ar2 corresponding with the first cross-sectional piston area Art. It further comprises a third actuator 73 provided with a third cross-sectional piston area Ar3 and a fourth actuator 74 provided with a fourth cross-sectional piston area Ar4. The third cross-sectional piston area Ar3 is twice as large as the first cross-sectional piston area Ar1 and the fourth cross-sectional piston area Ar4 is twice as large as the third cross-sectional piston area Ar3. The effective force area of the arrangement 1 can thus be changed in an optimal way by selected pressurization of suitable cylinder chambers depending upon operational requirements. For e.g. providing fast piston motion and minor force, the first cross-sectional piston area Ar1 (e.g. 1 area unit) is actuated. For achieving slow piston motion with high force, all actuators 71, 72, 73, 74 are actuated. All four cross-sectional piston areas Ar1, Ar2, Ar3 and Ar4 are used in such mode. This means that eight area units are used, i.e. the force areas of the first, second, third, fourth actuators 71, 72, 73, 74 are all used together. This implies the provision of an optimal combination of eight different force area units, which can be selected from required piston motion rate and force of the arrangement 1.

Figure 6B:
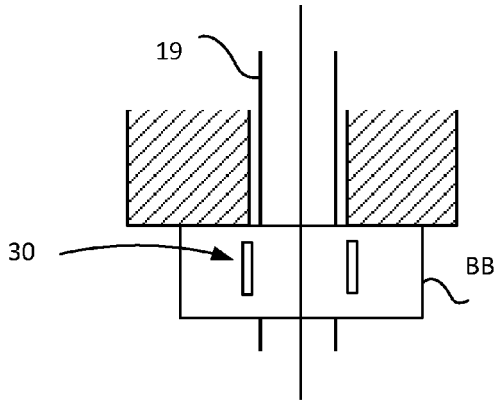

FIG. 6*b* illustrates a complement functionality using a membrane 30 of a sleeve block BB attached to a fundament or cylinder housing. The membrane 30 is autonomously pressurized by a separate fluid pressure supply (not shown) in case of malfunction of the arrangement, whereby a brake action is provided for stopping the piston rod 19 movement.

Figure 7A:
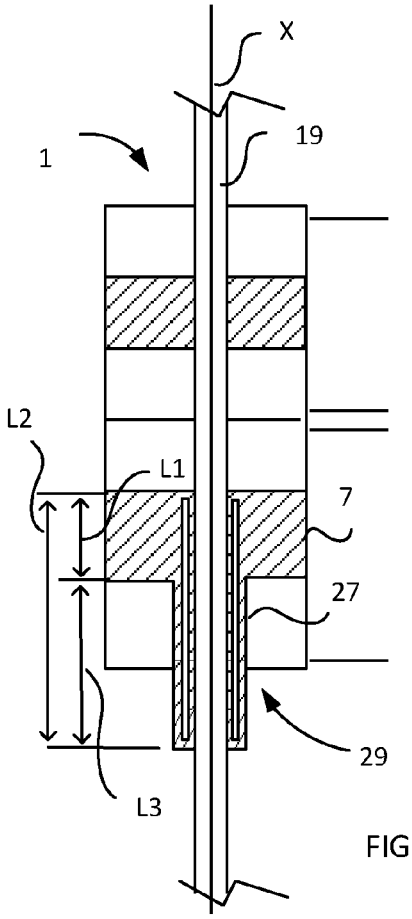
FIGS. 7*a* to 7*b* illustrate further aspects of the invention.
Figure 7B:
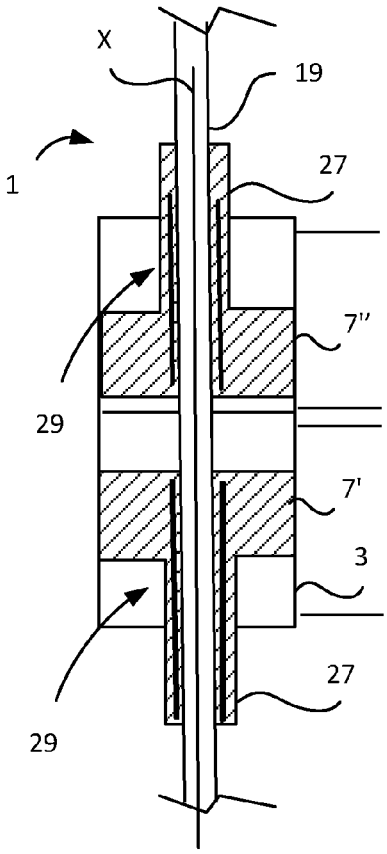

FIGS. 7*a* to 7*b* illustrate further aspects of the invention. FIG. 7*a* illustrates an arrangement 1 comprising one piston body 7 comprising the piston rod engagement and disengagement means 29. The sleeve portion 27 extends from one side of the piston body 7, wherein the opposite side is flat. The other piston of the arrangement 1 is rigidly fixed to the piston rod 19. By controlling the piston rod engagement and disengagement means 29 of the piston body 7, the arrangement 1 will have the capacity to add force or reduce force and thus exert high force for specific operation. FIG. 7*b* illustrates an arrangement 1 comprising a first and second piston body 7', 7" having plane sides (piston areas) facing each other and a cylinder wall there between. The sleeve portions 27 comprising the respective piston rod engagement and disengagement means 29 are extended in a direction away from each other. Such arrangement 1 can be made less bulky at the same time as a relatively large engagement area (achieving high friction between piston rod and piston body) will provide proper engagement. The relatively large engagement area also implies that the fluid pressure can be reduced within the piston rod engagement and disengagement means 29, which decreases wear and tear of the arrangement 1, still reaching sufficient engaging force.

Figure 8C:
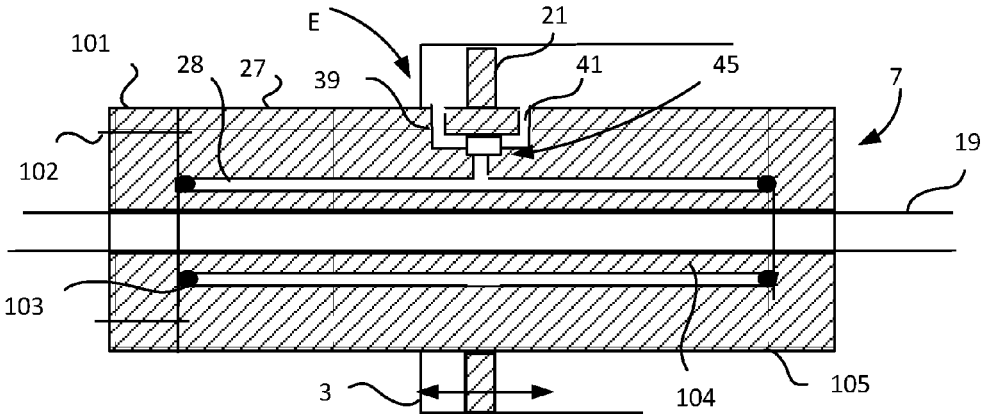
FIGS. 8*a* to 8*c* illustrate an embodiment comprising a membrane cavity.
Figure 8A:
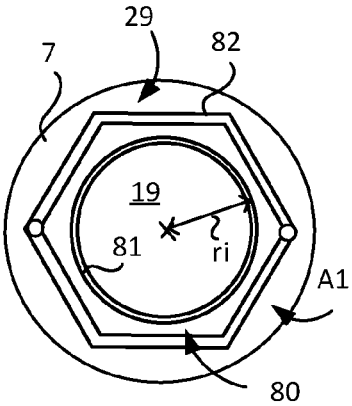
Figure 8B:
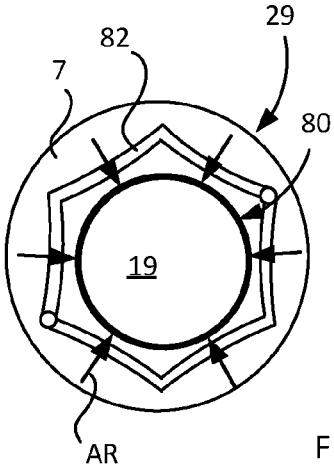

FIGS. 8*a* to 8*b* schematically illustrate a piston rod engagement and disengagement means 29 in a view transverse to the longitudinal direction. FIG. 8*a* shows a first piston body 7. A bore 80 (exhibiting an inner wall section 81) is provided centrally in the piston body 7 for encompassing a piston rod 19. An interior channel 82 is arranged in the piston body 7, which channel 82 is provided with six tangent section portions. The interior channel 82 is adapted for fluid communication with a fluid pressurized cylinder chamber (not shown). Pressurized fluid is fed into the interior channel 82 (membrane 30 cavity) from said cylinder chamber, wherein the inner wall section 81 expands in a radial direction inwardly according to arrows AR in FIG. 8*b*. In such way the piston body 7 will engage the piston rod 19. FIG. 8*c* shows a longitudinal cross-section of a piston body 7. Passages 39, 41 are in fluid communication with a membrane cavity 28 via a shuttle valve 45. The piston body 7 is slidingly mounted in a cylinder housing 3. End stroke position is marked with E. The piston body 7 comprises an inner casing 104 and outer housing 105. The inner casing 104 is releasable inserted into the outer housing 105. The inner casing 104 is made of a bronze material constituting base material. O-rings 103 are arranged at each side of the membrane cavity 28 formed by the mutually facing areas of the inner casing 104 and outer housing 105. The inner surface of the inner casing 104 surface facing the piston rod 19 exhibits a helical groove (not shown) for achieving even friction and guaranteed engagement between the inner surface and the piston rod 19. An end block 101 covers the membrane cavity 28 and is secured by bolts 102. The helical groove also provides for removal of excessive lubricating oil. When the membrane cavity 28 is pressurized, the inner casing 104 expands uniformly in radial direction towards the piston rod 19 and provides rigid engagement with the piston rod 19. When the pressure is released, the inner casing 104 reverts to its original measure. The piston body 7 involves the requirement of a low hydraulic pressure for engagement and securing the piston rod 19, frequently pressurizing, long distance movement along the piston rod 19, rust resistant, no axial displacement of the piston body 7 when the membrane cavity 28 is pressurized. The working temperature of the piston body 7 in this embodiment is between −30 up to +110 degrees Celsius.

Figure 9:
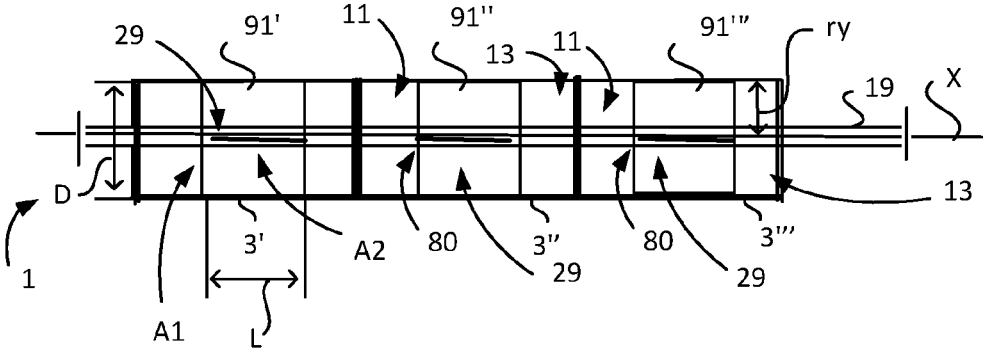
FIG. 9 illustrates one aspect of the invention.

FIG. 9 shows one aspect of the present invention. The arrangement 1 comprises three piston bodies 91', 91", 91'", each provided for engagement and disengagement from a piston rod 19 in a way similar to that has been described for previous embodiments. The arrangement 1 further comprises a first, second and third cylinder housing 3', 3", 3'" extending in a longitudinal direction X. Each cylinder housing 3', 3", 3'" encompasses the respective piston body 91', 91", 91'". The respective piston body divides the respective cylinder housing 3', 3", 3'" in a first 11 and second 13 cylinder chamber. The arrangement 1 is adapted for connection to a valve member means (not shown) of a fluid supply device (not shown). The piston rod 19 extends through the piston bodies 91', 91", 91'". The first piston body 91' comprises a piston rod engagement and disengagement means 29, which is adapted to engage or disengage the first piston body 91' to/from the piston rod 19, wherein an engagement area A2 defined by the engagement between the first piston body 91' and the piston rod 19 is larger than a cross-sectional piston area A1 of the piston body 91'. The cross-sectional piston area A1 is defined as the area of the piston, which (effective area) extends in a transverse direction to the longitudinal direction X. The amount of the force generated by each cylinder depends upon the effective area of the piston body 91', 91", 91'" and the fluid pressure in the utilized cylinder chamber (11 or 13). The engagement area A2 is defined as an effective area determined by the engagement between the piston rod engagement and disengagement means 29 comprising a central bore 80 (guiding or fixing the piston rod 19) of the piston body 91', 91", 91'", which bore 80 extends transverse to the extension of the cross-sectional piston area A1 of each piston body 91', 91", 91'" and along the longitudinal direction X. The cross-sectional piston area A1 of the piston body respective the engagement area A2 can be determined by the formulas:

$$A1=\pi*(ry^2-ri^2)$$

$$A2=2*\pi*ri*L$$

Where ry (see FIG. 9) is the outer radius of the piston body and ri (see FIG. 8*a* for example illustration) is the radius of the central bore 80, L is the length of the central bore or piston rod engagement and disengagement means seen in a direction along the longitudinal direction X.

The piston body 91' exhibits an engagement area A2 being larger than the cross-sectional area A1:

A2>A1

It has surprisingly been shown by experiments of the applicant that the engagement of the piston body to the piston rod in such way is enhanced for an arrangement using the same fluid pressure for the piston rod engagement and disengagement means (e.g. membrane member 30) as for the cylinder chamber comprising the effective piston area.

Figure 10A:
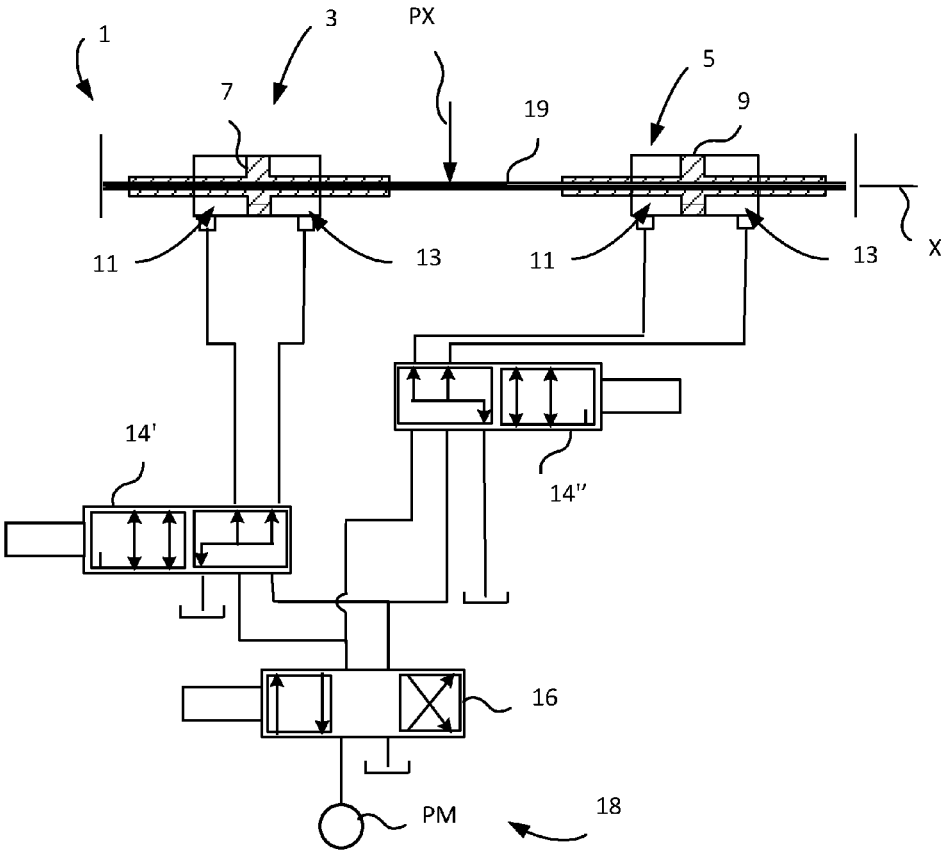
FIGS. 10*a* to 10*d* illustrate a method for operating an arrangement according to one aspect of the present invention.
Figure 10B:
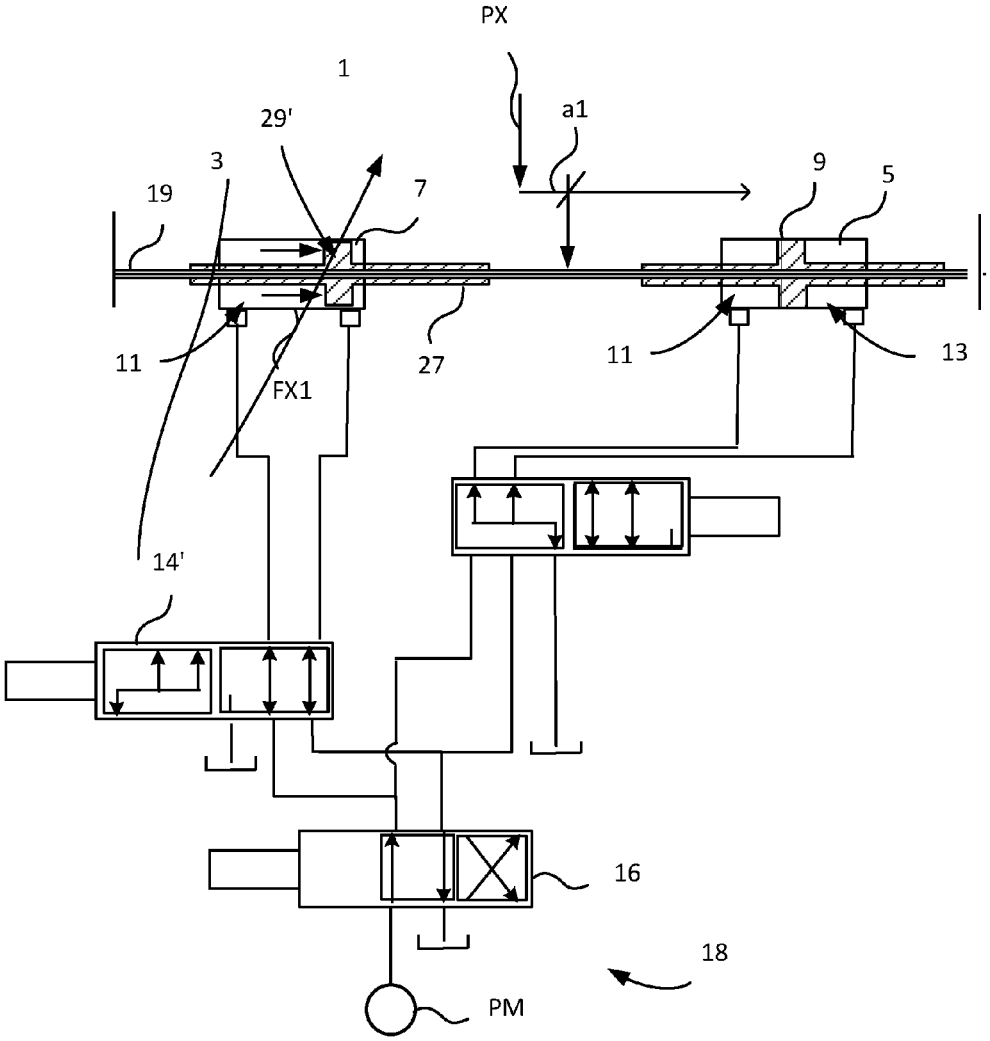
Figure 10C:
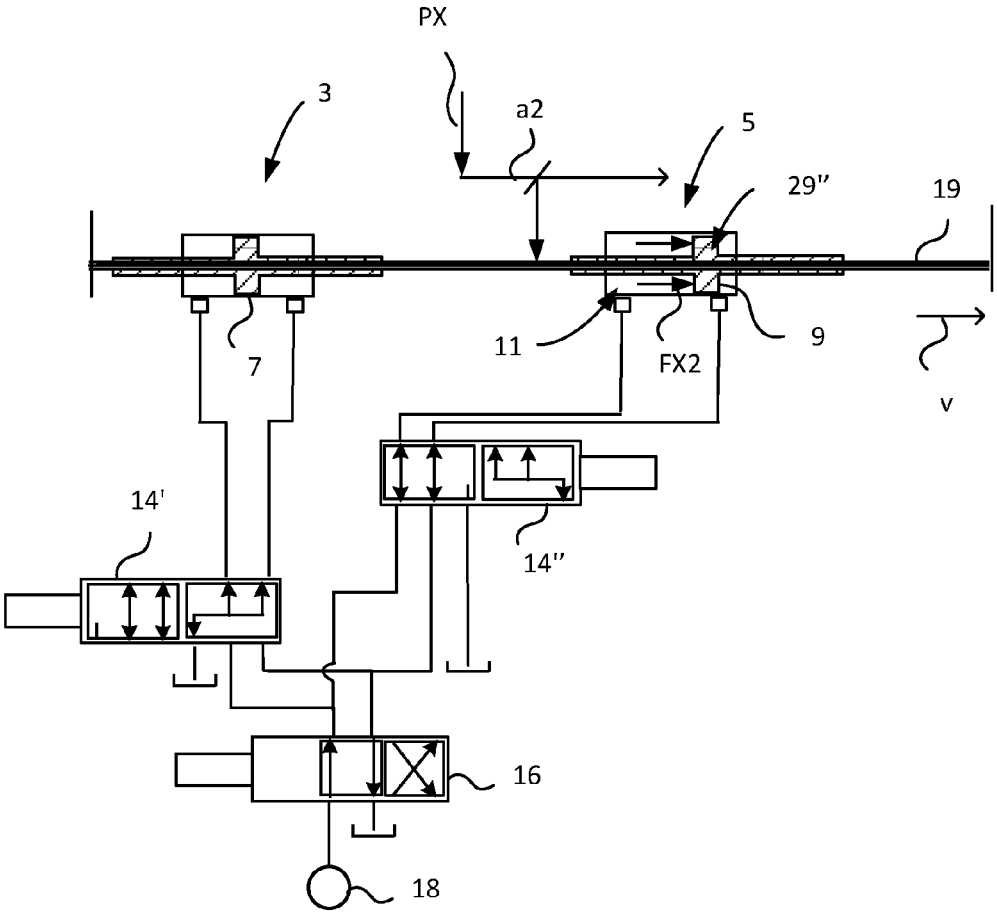
Figure 10D:
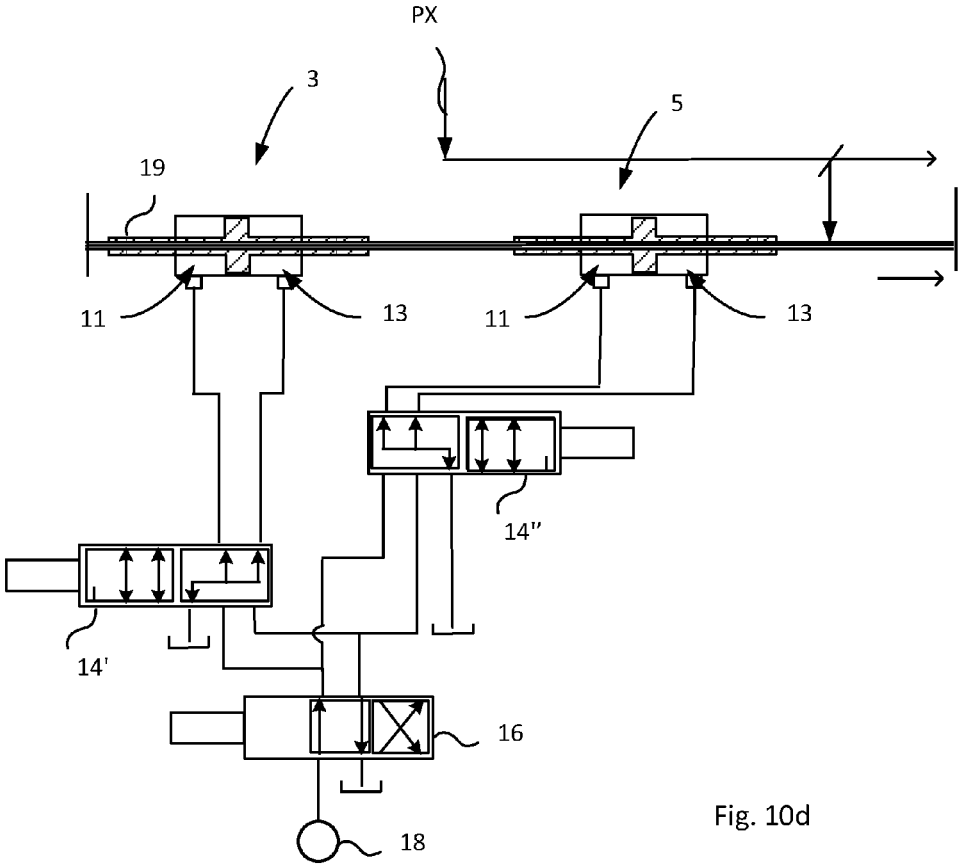

FIGS. 10*a* to 10*d* schematically illustrate a method for operating the motion of a piston rod 19 of an arrangement 1 according to one aspect of the present invention. The arrangement 1 comprises a supply device 18 provided for controlled feeding of hydraulic fluid for pressurizing the arrangement 1. The arrangement 1 comprises a first cylinder 3 and a second cylinder 5. A first piston body 7 is arranged in the first cylinder 3 and a second piston body 9 is arranged in the second cylinder 5. A spring mechanism (not shown) is arranged in respective cylinder 3, 5 for positioning respective piston body 7, 9 symmetrically (seen in a longitudinally direction between end walls of the cylinder) in the cylinder 3, 5, when respective cylinder chamber 11, 13 not being pressurized. Each piston body 7, 9 is provided with a piston rod engagement and disengagement means (not shown) adapted to engage (couple) or disengage (release) the piston bodies 7, 9 to/from a common piston rod 19. A pump PM is connected to a control valve 16, which in turn is connected to respective cylinder chamber 11, 13 of the arrangement 1 via first and second logic valves 14', 14". The first cylinder 3 is connected to the control valve 16 via the first logic valve 14' adapted for directing the hydraulic flow to the respective cylinder chamber 11, 13 of the first cylinder 3. The second cylinder 5 is connected to the control valve 16 via the second logic valve 14" adapted for directing the hydraulic flow to the respective cylinder chamber 11, 13 of the second cylinder 5. In FIG. 10*b* is shown that the first piston body 7 is actuated by pressurizing the first cylinder chamber 11 of the first cylinder 3 (with a force FX1). This is made by opening the control valve 16 and the first logic valve 14'. The direction of motion is operated by controlling the control valve 16 and the actuating of the first piston body 7 is thus made by operating the first logic valve 14'. By pressurizing the first cylinder chamber 11 of the first cylinder 3, the first piston body 7 engages the common piston rod 19 and propels the latter by means of the piston rod engagement and disengagement means 29'. A membrane member (not shown) of the piston rod engagement and disengagement means 29' is pressurized for achieving said engagement. The piston rod 19 is moved a distance a1 from the starting reference point PX shown in FIG. 10*a*. In FIG. 10*c* is shown that the second piston body 9 is actuated by pressurizing the first cylinder chamber 11 of the second cylinder 5 (with a force FX2). The direction of motion is operated by controlling the control valve 16 and the actuating of the second piston body 9 is made by operating the second logic valve 14". By pressurizing the first cylinder chamber 11 of the second cylinder 5, the second piston body 9 engages the common piston rod 19 by means of the piston rod engagement and disengagement means 29". The piston rod 19 has in total made a distance a2 from the starting reference point PX. The motion is performed continuously with a predetermined velocity v and the first and second logic valves 14', 14" are adapted to regulate the fluid flow to the respective first and second cylinders 3, 5 in such way that a smooth motion of the piston rod 19 is performed by alternately using the first and second logic valves 14', 14" and providing said velocity. Both first cylinder chambers 11 of the respective first and second cylinder 3, 5 may simultaneously be pressurized (not shown) for achieving a larger force. FIG. 10*d* shows that both first and second logic valves 14', 14" are turned off, wherein none of the cylinder chambers 11, 13 being pressurized. The arrangement 1 is thus adapted for disengaging both piston bodies 7, 9 from the piston rod 19 for propelling the latter using the kinetic energy of the mass (in a way reminding of a freewheel clutch) performing said velocity.

Figure 11A:
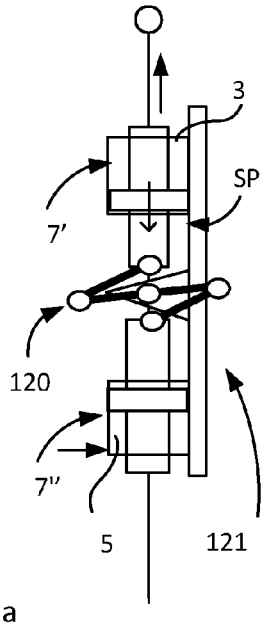
FIGS. 11*a* to 11*e* illustrate a further aspect.
Figure 11B:
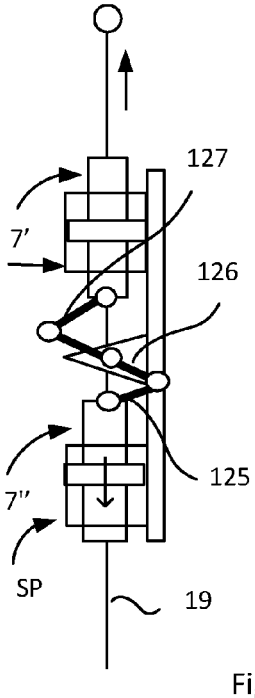
Figure 11C:
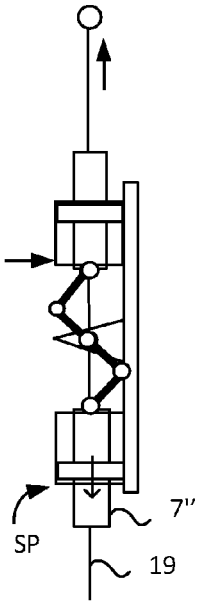
Figure 11D:
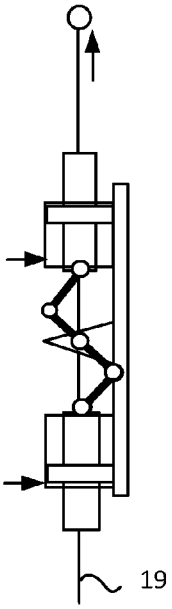
Figure 11E:
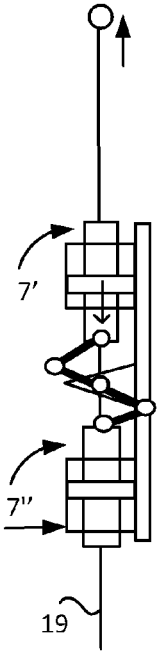

FIGS. 11*a* to 11*e* show one aspect using a linkage arrangement 120 of a returning arrangement 121. The returning arrangement 121 is provided for returning first piston body 7' to a starting point SP relatively its cylinder housing 3, in which starting point SP the first piston body 7' is engaged to the piston rod 19 for propelling the piston rod 19. The linkage arrangement 120 is designed as a reverse motion linkage arrangement which is provided for moving the first piston body 7' in one direction when the second piston body 7" is moved in the opposite direction and vice versa. The linkage arrangement 120 comprises a flexible member (not shown) for compensating instantaneously shifting momentum from propelling the first piston body 7' to propelling the second piston body 7". The linkage arrangement 120 is coupled to the respective first and second piston bodies 7. 7" for mutually returning respective piston body 7',7" to its starting point after fulfilled piston stroke. FIG. 11*a* shows that the second piston body 7" is actuated by the pressurized cylinder chamber 5. The end of the second piston body 7" facing the first piston body 7' is pivotally mounted to a first linkage arm 125 which in turn is pivotally coupled to a pivoting central arm 126. The end of the first piston body 7' facing the second piston body 7" is pivotally mounted to a second linkage arm 127, which in turn is pivotally coupled to the central arm 126. FIG. 11*b* shows that the first piston body 7' is propelled by pressurized fluid, wherein the linkage arrangement 120 provides a movement of the second piston body 7" towards its starting point SP. In FIG. 11*c* the second piston body 7" has reached the starting point by means of the action of the linkage arrangement 120. During the shift of actuated piston body, both pistons being actuated by pressurized fluid in respective fluid chamber in shifting (See FIG. 11*d*) momentum from propelling the first piston body 7' to propelling the second piston body 7". FIG. 11*e* shows that the shifting is completed and that the second piston body 7" again is propelled towards the first piston body 7' and the latter being moved towards the second piston body 7' in a returning motion by means of the linkage arrangement 120.

FIGS. 12*a* to 12*b* shows a returning arrangement comprising a chain wheel device 130 including a chain arrangement 131 mounted in engagement with respective first 7' and second 7" piston body in such way that when the first piston body 7' is propelled in one direction OD, the second piston body 7" is returned to its starting point SP and when the second piston body 7" is propelled in said one direction OD, the first piston body 7' is returned to its starting point SP. In FIG. 12*a* is shown that pressure PEE1 propels the first piston body 7' and in FIG. 12*b* is shown that pressure PEE2 propels the second piston body 7" and mutually propels the piston rod 19 in one direction OD.

FIG. 13 illustrates an arrangement having separate fluid supply systems. A first fluid supply and control system 140 is coupled to the respective membrane member (not shown) of the piston bodies 7. The membrane member is thus arranged in direct fluid communication with the fluid supply, i.e. the pressurized fluid is fed directly into the respective protruding part PPT (protruding from the cylinder housing 3) of the piston body 7 and membrane cavity for pressurizing the membrane member and thereby provide engagement between the respective piston body 7 and the piston rod 19. That is, the first fluid supply and control supply system 140 used for the membrane member is separate from a second fluid supply and control system 141 used for the actuating of the piston bodies 7 in the cylinder housings via lines 149 for propelling the piston bodies 7. A yet further separate fluid supply system 142 is provided for autonomous controlling braking action of the piston rod 19 by pressurizing a separate membrane engaging a braking block DP3. The systems are in turn controlled and monitored by a control processor unit CPU.

Figure 14A:
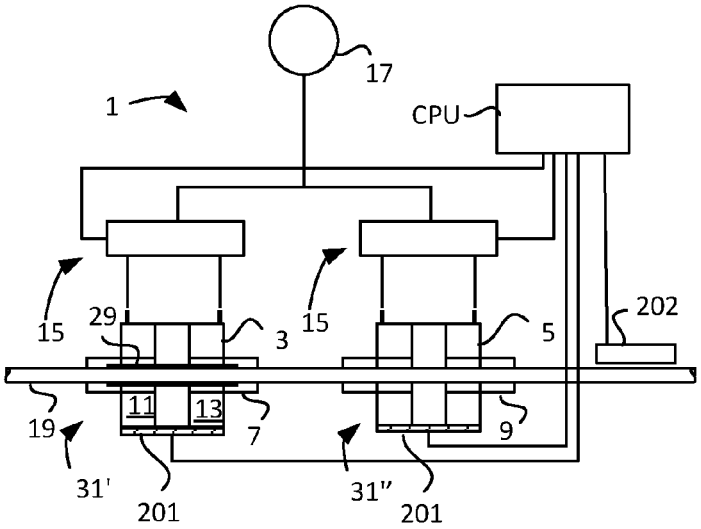
FIG. 14*a* illustrates an arrangement according to one example.

FIG. 14*a* illustrates an arrangement according to one example. The arrangement 1 comprises two actuators 31', 31". A sensor device 201 is arranged to the elongated fluid actuator arrangement 1 for determining an actual cylinder-piston feature value, a control unit CPU is associated with the sensor device 201 and with the valve member means 15 for controlling said engaging and disengaging of the respective piston body 7, 9 to/from the piston rod member 19 by means of an engagement and disengagement means 29. Thereby is achieved that a monitoring and control of the first piston body motion in the first cylinder housing and also monitoring and control of the second piston body motion in the second cylinder housing. An engagement zone is defined as an engagement area corresponding with the contact and clamping area of the first piston body 7 (or second piston body 9). I.e. the area of the piston body which is in engagement with the piston rod 19 when the respective piston body 7, 9 is engaged. The measure of the engagement area e.g. has an extension corresponding with the radially inward projected extension of a cavity of the piston rod engagement and disengagement means 29. The cavity is co-axially arranged in the piston body 7, 9 and exhibits the same central axis as the cylinder housing 3, 5 and the piston rod 19 in the longitudinal direction. The cavity may be arranged for fluid communication with the respective first and second cylinder chamber 11, 13 (alternately or simultaneously). Optionally, a piston position sensor device 202 is arranged to the elongated fluid actuator arrangement 1 for determining a piston rod member position value, a control unit CPU is associated with the sensor device 202 and with the valve member means 15 for controlling said engaging and disengaging of the piston body 7 to/from the piston rod member 19. The control unit CPU is adapted to control the valve member means 15 from a desired cylinder-piston feature value in regard to said determined actual cylinder-piston feature value and/or said piston rod member position value, for regulating fluid flow fed from the fluid supply device 17 to the respective first and second cylinder chamber 11, 13.

Figure 14B:
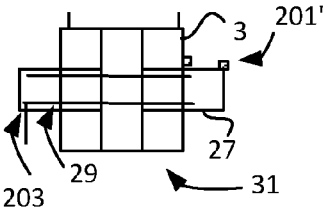
FIGS. 14*b*-14*c* illustrate further examples of actuators.
Figure 14C:
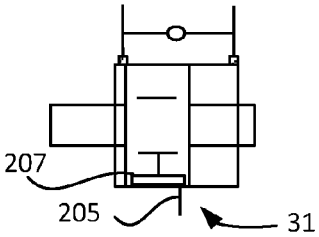

FIGS. 14*b*-14*c* illustrate further examples of actuators 31. The piston rod engagement and disengagement means 29 in FIG. 14*b* is adapted to be activated by said fluid supply device (not shown) via a fluid connection 203 arranged on a sleeve portion 27 of the respective piston body outside the cylinder housing 3. In such way is achieved that direct fluid transfer for a clamping action is provided. A micro-switch sensor 201' is arranged at the piston body outer end and the cylinder housing cap end. The piston rod engagement and disengagement means in FIG. 14*c* is adapted to be activated by said fluid supply device via a fluid connection 205 arranged on the cylinder housing and coupled to a longitudinal groove 207 in an interface between the piston body and the cylinder housing interior, which groove 207 is in fluid communication with the piston rod engagement and disengagement means. The arrangement is provided with a pressure sensor PS for measuring the pressure difference between the first and second cylinder chamber.

Figure 15A:
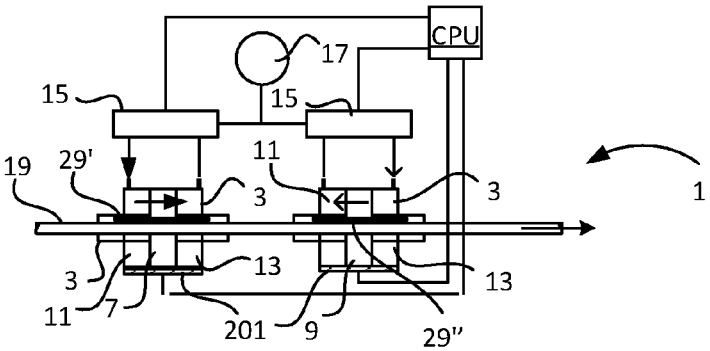
FIGS. 15*a*-15*d* illustrate a method of operating an arrangement.
Figure 15B:
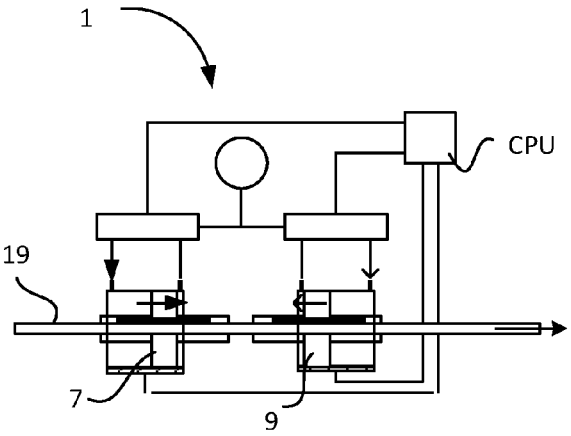
Figure 15C:
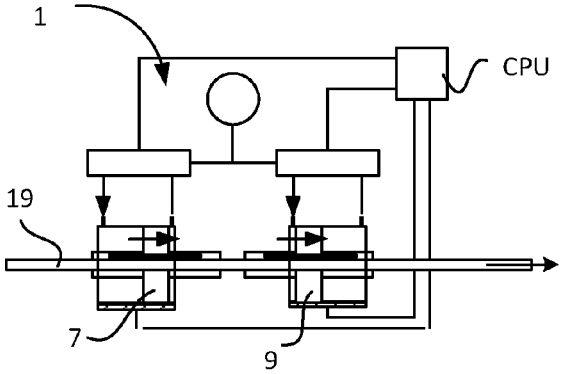
Figure 15D:
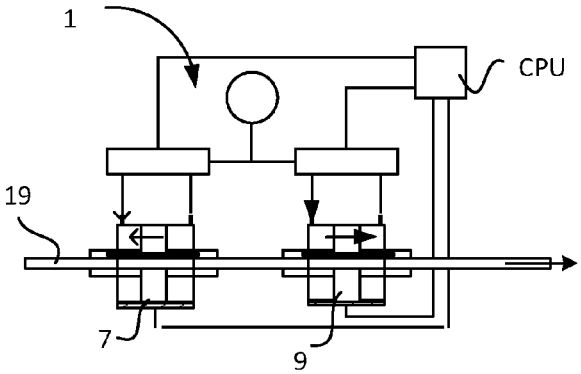
Figure 16:
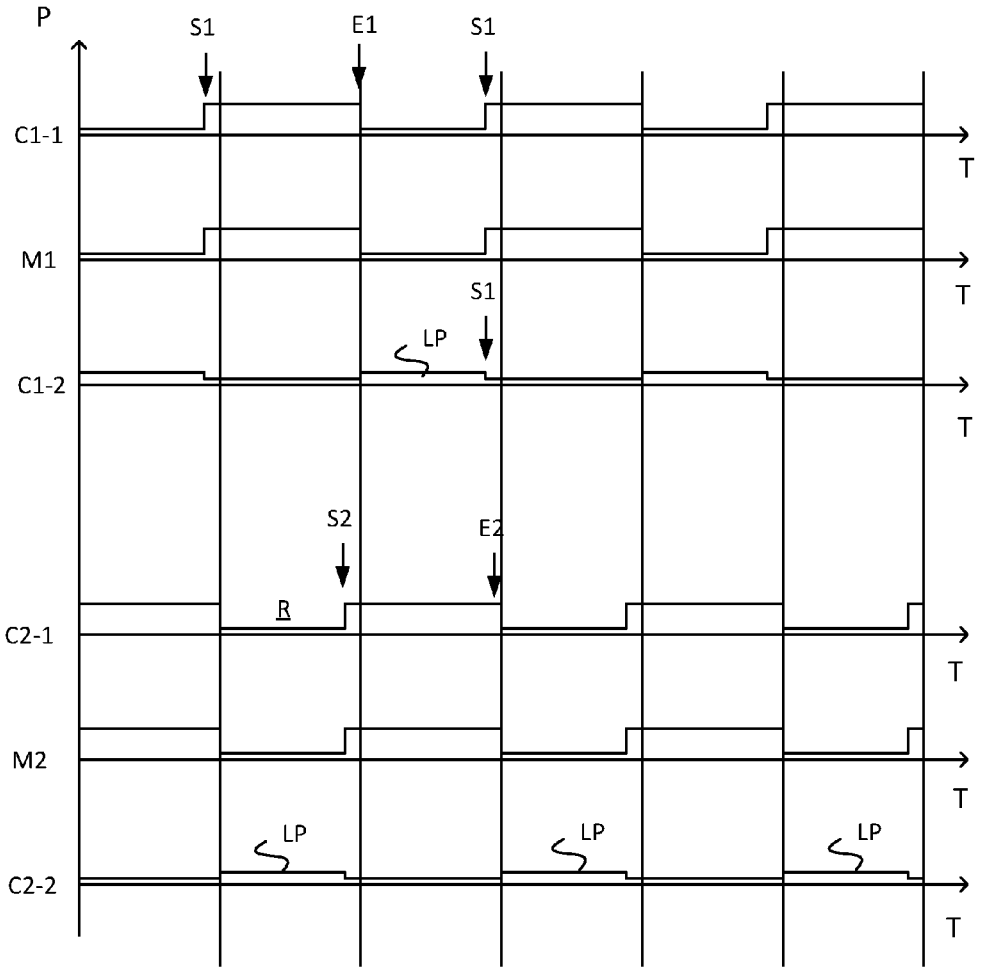
FIG. 16 illustrates schematic actuation of actuators as an example.

FIGS. 15*a*-15*d* illustrate an example of a method of operating an arrangement 1. The method is provided for controlling the motion of the elongated fluid actuator arrangement 1 including a first cylinder housing 3 encompassing a first piston body 7 comprising a first piston rod engagement and disengagement means 29' and dividing the first cylinder housing 3 in a first and second cylinder chamber 11, 13 coupled to a fluid supply 17 via a valve member means 15, a control unit CPU is associated with a sensor device 201 of the arrangement 1 for determining an actual cylinder-piston feature value and is coupled to said valve member means 15 for regulating fluid flow to said first cylinder housing 3. A piston rod 19 extends through the first piston body 7. The method includes the steps of providing a first actual cylinder-piston feature value to the control unit CPU and furthermore comparing the first actual cylinder-piston feature value with a first desired cylinder-piston feature value. It comprises also the steps of regulating fluid flow to the respective first and second cylinder chamber 11, 13 and repeating the preceding steps until the first actual cylinder-piston feature value corresponds with the first desired cylinder-piston feature value. The arrangement 1 further comprises a second cylinder housing 5 encompassing a second piston body 9 comprising a second piston rod engagement and disengagement means 29" and dividing the second cylinder housing 5 in a first and second cylinder chamber 11, 13 coupled to said fluid supply 17 via the valve member means 15. The control unit CPU is associated with a further sensor device 201 (linear potentiometer attached to the second cylinder housing 5) for determining an actual cylinder-piston feature value and is coupled to said valve member means 15 for regulating fluid flow to said second cylinder housing 5. The method includes pressurizing the first cylinder chamber 11 of the first cylinder housing 3 with a first fluid pressure feature for engaging the first piston rod engagement and disengagement means 29' to the piston rod 19 and driving the first piston body 7 with the piston rod 19 from a first start position (S1, see FIG. 16) to a first end position E1 (See FIG. 16). The method further comprises the steps of pressurizing the second cylinder chamber 13 of the second cylinder housing 5 with a second fluid pressure feature for disengaging the second piston rod engagement and disengagement means 29" from the piston rod 19 and retracting the second piston body 9 to a second start position S2 (see FIG. 16) and pressurizing the first cylinder chamber 11 of the second cylinder housing 5 with the first fluid pressure feature for engaging the second piston rod engagement and disengagement means 29" to the piston rod 19 and driving the second piston body 9 with the piston rod 19 from the second start position S2 to a second end position E2 (see FIG. 16). The valve member means 15 is controlled to manage the second start position S2 to precede said first end position E1 with an overlap time interval. In FIG. 15*a* the first piston body 7 propels the piston rod 19 at the same time as the second piston body 9 is retracted. The motion and rates of the respective piston body being controlled by the control unit CPU. In FIG. 16*b* the first piston body 7 reaches the first end position and the second piston body 9 reaches the second start position. In FIG. 16*c* is shown the position wherein the piston bodies 7, 9 drive the piston rod in said overlap time interval for achieving smooth performance of the arrangement 1. In FIG. 15*d* is shown that the second piston body 9 propels the piston rod 19 at the same time as the first piston body 7 is retracted. The motion and rates of the respective piston body being controlled by the control unit CPU.

FIG. 16 illustrates schematic actuation scheme of actuators as an example. P marks fluid pressure applied to the first C1-1 and the second C1-2 cylinder chamber of the first cylinder housing and also the pressure applied to the engagement and disengagement means of the first piston body of the first cylinder housing by controlling the valve member means (e.g. reference 15) by means of commands from the control unit CPU in regards from signals fed from sensors mounted to the cylinder housings. The levels of the pressure may fluctuate due to various loads on the piston rod etc. T marks time. The first cylinder chamber C1-1 of the first cylinder housing is pressurized as well as the engagement and disengagement means of the first piston body for clamping action and driving of the first piston body (with the piston rod) from a first start position S1 to a first end position E1. Thereafter, the second cylinder chamber C1-2 of the first cylinder housing is pressurized with a lower pressure LP for retraction of the piston body back to the first start position S1, wherein the engagement and disengagement means being controlled during said retraction to disengage the first piston body from the piston rod. During propulsion of the first piston body from the first start position S1 to the first end position E1, the second piston body of the second cylinder housing is retracted R. The time for retraction of the second piston body is shorter than the time for the working stroke of the first piston body from the first start position S1 to the first end position E1. The second start position S2 of the second piston body precedes the first end position of the working stroke of the first piston body. The working stroke of the second piston body prevails from the second starting position S2 to the second end position E2. In the same way, subsequently, the first start position S1 of first piston body precedes the second end position E2 of the working stroke of the second piston body for providing an overlap time interval. The time for retraction of the first piston body is shorter than the time for the working stroke of the second piston body from the second start position S2 to the second end position E2.

The present invention is of course not in any way restricted to the preferred embodiments described above, but many possibilities to modifications, or combinations of the described embodiments, thereof should be apparent to a person with ordinary skill in the art without departing from the basic idea of the invention as defined in the appended claims. The valve member means may comprise a logic valve of suitable type. The valve member may comprise a 5 ports/2 valve positions unit, so called 5/2 valve or others. The valve member may comprise a two-way valve of any type suitable for the arrangement. The shuttle valve may be replaced by any other suitable type of valves for fulfilling the functionality of pressurizing the piston rod engagement and disengagement means in view of pressurizing one cylinder chamber at the time. The manoeuvring of the valve member may be performed by means of a solenoid connected to a control unit adapted for controlling the valve member and thereby the arrangement. The arrangement may be adapted for fast and high clamp force engagement of the piston device for propelling the latter accurate also for acceleration of heavy loads. The selection of material is possible in many ways. For example, aluminium bronze or other compositions are possible. A variety of alloying agents such as iron, nickel, manganese can be added to the aluminium bronze. Stainless steel, chrome steel or similar material is also possible as material for the piston body and cylinder housing and piston rod. By manoeuvring the valve member, such as a logical valve, the same arrangement can perform also lower force and slow motion rate of the piston rod arrangement. A logical valve can be manoeuvred by the control unit to shut down the fluid flow to excluded cylinder/cylinders and only direct fluid flow to only one cylinder. There are different types of valves that can be used for providing the above-mentioned aspects and other aspects. Electro-hydraulic controlled valves or other types of directly controlled electro-hydraulic logical valves, etc. can be used. The arrangement can be put into use in civil and military, manned and unmanned aircraft: Leading/Trailing Edge Flap Actuators; Landing Gear Actuators; Air Brakes; Primary Servo Actuators (PSA); Electro-Hydrical Actuator (EHA) applications etc. The fluid can be hydraulic oil, gas or other. The invention may belong to any of the segments; construction industry, jacking systems for oil well drilling and service platforms, agricultural equipment industry, marine industry, crane manufacture industry.

The invention claimed is:

1. An elongated fluid actuator arrangement comprising:

a first and second cylinder housing (3, 5) extending in a longitudinal direction (X), wherein each respective one of the first and second cylinder housing (3, 5) encompasses a respect first and second piston body (7, 9), wherein:

the respective first and second piston body (7, 9) divide the respective cylinder housing (3, 5) in a first and second cylinder chamber (11, 13);

the arrangement (1) is configured for connection to a valve member means (15) of a fluid supply device (17);

a piston rod member (19) extends through said respective first and second piston bodies (7, 9);

the first piston body (7) comprises a piston rod engagement and disengagement means (29), which is configured to engage or disengage the first piston body (7) to/from the piston rod member (19), wherein an engagement area (A2), defined by an engagement zone between the first piston body (7) and the piston rod member (19), is larger than a cross-sectional piston area (Al) of the first piston body (7);

the arrangement (1) further comprises a second cylinder housing (5) encompassing a second piston body (9) comprising a second piston rod engagement and disengagement means (29") and dividing the second cylinder housing (5) in a first and second cylinder chamber (11, 13) coupled to a fluid supply (17) via a valve member means (15);

a sensor device is arranged to the elongated fluid actuator arrangement (1) for determining an actual cylinder-piston feature value;

a control unit (CPU) is associated with the sensor device and with the valve member means (15) for controlling said engaging and disengaging of the piston body (7) to/from the piston rod member (19); and the control unit (CPU) is configured to control the valve member means (15) from a desired cylinder-piston feature value in regard to said determined actual cylinder-piston feature value and/or said piston rod member position value, for regulating fluid flow fed from the fluid supply device (17) to the respective first and second cylinder chamber (11, 13); wherein the time for retraction of the second piston body is shorter than the time for the working stroke of the first piston body from the first start position to the first end position.

2. The arrangement according to claim 1, wherein the first piston body (7) comprises:

a first protruding portion (21) protruding in a direction radially outward with a first measure (D1), defining opposite cross-sectional piston areas (23, 25), and exhibiting a first length (L1) in said longitudinal direction (X); and a first sleeve portion (27) having in cross-section a smaller second measure (D2) than the first measure (D1), and with an additional measure (L3) to the first length (L1) defining a second length (L2);

wherein said first sleeve portion (27) comprises the piston rod engagement and disengagement means (29) configured to be operated by said fluid supply device (17).

3. The arrangement according to claim 1, wherein the piston rod engagement and disengagement means (29) are configured to be operated by said fluid supply device (17) via said cylinder chambers (11, 13).

4. The arrangement according to claim 1, wherein the piston rod engagement and disengagement means (29) comprise a cavity (28) in a first sleeve portion (27) and forming a membrane member (30), which cavity (28) is configured for fluid communication with respective cylinder chamber (11, 13).

5. The arrangement according to claim 1, wherein a main fluid passage (35) is configured for fluid communication with the piston rod engagement and disengagement means (29) and joins a branch junction (37, 45, 60) diverging into a first and second fluid passage (39, 41) configured for fluid communication with the respective cylinder chamber (11, 13).

6. The arrangement according to claim 5, wherein at least the first fluid passage (39) enters at the cross-sectional piston area (23) of the first cylinder chamber (11).

7. The arrangement according to claim 1, wherein the protruding portion (21) and the sleeve portion (27) are made in one piece.

8. The arrangement according to claim 1, wherein the second piston body (9) comprises a second piston rod engagement and disengagement means (29").

9. The arrangement according to claim 8, wherein the second piston body (9) comprises a second protruding portion (22) having a third measure (D3) and a second sleeve portion (27") having a smaller fourth measure (D4).

10. The arrangement according to claim 9, wherein the first (D1) measure corresponds with the third (D3) measure.

11. The arrangement according to claim 1, wherein the first piston body (7) exhibits a second length (L2) that is larger than a cylinder housing length (HL) of the first cylinder housing in said longitudinal direction (X).

12. The arrangement according to claim 1, wherein a third cylinder housing (3"') encompassing a third piston body (91"') is arranged to said piston rod member (19), the third piston body (91"') comprises a third piston rod engagement and disengagement means (29"').

13. The arrangement according to claim 1, wherein a first cross- sectional piston area (Ar1) of the first piston body (72) differs in measure from a second cross-sectional piston area (Ar3) of the second piston body (73).

14. The arrangement according to claim 1, wherein the arrangement comprises a first piston body (72) provided with a first cross-sectional piston area (Ar1), a second piston body (73) provided with a second cross-sectional piston area (Ar2) corresponding with the first cross-sectional piston area (Ar1), a third piston body (73) provided with a third cross-sectional piston area (Ar3), a fourth piston body (74) provided with a fourth cross-sectional piston area (Ar4), the third cross-sectional piston area (Ar3) is twice as large as the first cross-sectional piston area (Ar1), the fourth cross-sectional piston area (Ar4) is twice as large as the third cross-sectional piston area (Ar3).

15. The arrangement according to claim 1, wherein the arrangement (1) is provided with a returning arrangement (RS, 121, 130) provided for returning at least one piston body (7) to a starting point (SP) relatively its cylinder housing (3), in which starting point (SP) the piston body (7) being arranged for engagement with the piston rod (19) for propelling the piston rod (19).

16. The arrangement according to claim 1, wherein the arrangement (1) is configured to a lift system or a high bay storage system.

17. The arrangement according to claim 1, wherein the piston rod engagement and disengagement means (29) is configured to be activated by said fluid supply device (17) via a fluid connection arranged on a sleeve portion (27) of the respective piston body (7, 9) outside the cylinder housing (3, 5).

18. The arrangement according to claim 1, wherein the piston rod engagement and disengagement means (29) is configured to be activated by said fluid supply device (17) via a fluid connection arranged on the cylinder housing (3) coupled to a longitudinal groove in an interface between the piston body and the cylinder housing interior, which groove is in fluid communication with the piston rod engagement and disengagement means (29).

19. The arrangement according to claim 1, wherein a sensor device is arranged to the elongated fluid actuator arrangement (1) for determining an actual cylinder-piston feature value, a control unit (CPU) is associated with the sensor device and with the valve member means (15) for controlling said engaging and disengaging of the piston body (7) to/from the piston rod member (19).

20. The arrangement according to claim 1, wherein a sensor device is arranged to the elongated fluid actuator arrangement (1) for determining a piston rod member position value, a control unit (CPU) is associated with the sensor device and with the valve member means (15) for controlling said engaging and disengaging of the piston body (7) to/from the piston rod member (19).

21. The arrangement according to claim 19, wherein the control unit (CPU) is configured to control the valve member means (15) from a desired cylinder-piston feature value in regard to said determined actual cylinder-piston feature value and/or said piston rod member position value, for regulating fluid flow fed from the fluid supply device (17) to the respective first and second cylinder chamber (11, 13).

22. A method for controlling the motion of an elongated fluid actuator arrangement (1) including a first cylinder housing (3) encompassing a first piston body (7) comprising a first piston rod engagement and disengagement means (29') and dividing the first cylinder housing (3) in a first and second cylinder chamber (11, 13) coupled to a fluid supply (17) via a valve member means (15); a second cylinder housing (5) encompassing a second piston body (9) comprising a second piston rod engagement and disengagement means (29") and dividing the second cylinder housing (5) in a first and second cylinder chamber (11, 13) coupled to a fluid supply (17) via a valve member means (15); a control unit (CPU) is associated with a sensor device (201) of the arrangement (1) for determining an actual cylinder-piston feature value and is coupled to said valve member means (15) for regulating fluid flow to said first cylinder housing (3) and said second cylinder housing (5); a piston rod (19) extends through the first piston body(7), the method comprises the steps of:

providing a first actual cylinder-piston feature value to the control unit (CPU);

comparing the first actual cylinder-piston feature value with a first desired cylinder-piston feature value;

regulating fluid flow to the respective first and second cylinder chamber (11, 13);

repeating the preceding steps until the first actual cylinder-piston feature value corresponds with the first desired cylinder-piston feature value;

pressurizing the first cylinder chamber (11) of the first cylinder housing (3) with a first fluid pressure, wherein the first piston body (7) comprises an elongated sleeve-shaped engagement and disengagement means extending in the longitudinal direction (X), the first engagement and disengagement means is arranged to engage and/or disengage with the piston rod (19) by means of a cavity that can be pressurized;

driving the first piston body (7) with the piston rod (19) from a first start position (Si) to a first end position (El);

retracting the second piston body (9) to a second start position (S2);

pressurizing the first cylinder chamber (11) of the second cylinder housing (5) with the first fluid pressure feature, wherein the second piston body (9) comprises an elongated sleeve-shaped engagement and disengagement means extending in the longitudinal direction (X), the second engagement and disengagement means is arranged to engage and/or disengage with the piston rod (19) by means of a cavity that can be pressurized; and driving the second piston body (9) with the piston rod (19) from the second start position (S2) to a second end position (E2), wherein:

said valve member means (15) is controlled to manage the second start position (S2) to precede said first end position (El) with an overlap time interval; and the time for retraction of the second piston body is shorter than the time for the working stroke of the first piston body from the first start position to the first end position.

23. The method according to claim 22, wherein:

the arrangement (1) further comprises a second cylinder housing (5) encompassing a second piston body (9) comprising a second piston rod engagement and disengagement means (29") and dividing the second cylinder housing (5) in a first and second cylinder chamber (11, 13) coupled to a fluid supply (17) via a valve member means (15), a control unit (CPU) is associated with a sensor device (201) of the arrangement (1) for determining an actual cylinder-piston feature value and is coupled to said valve member means (15) for regulating fluid flow to said second cylinder housing (5), a piston rod (19) extends through the second piston body (9); and the method further comprises the steps of:

pressurizing the first cylinder chamber (11) of the first cylinder housing (3) with a first fluid pressure feature for engaging the first piston rod engagement and disengagement means (29') to the piston rod (19) and driving the first piston body (7) with the piston rod (19) from a first start position (Si) to a first end position (El);

pressurizing the second cylinder housing (5) of the second cylinder housing (5) with a second fluid pressure feature for disengaging the second piston rod engagement and disengagement means (29") from the piston rod (19) and retracting the second piston body (9) to a second start position (S2); and pressurizing the first cylinder chamber (11) of the second cylinder housing (5) with the first fluid pressure feature for engaging the second piston rod engagement and disengagement means (29") to the piston rod (19) and driving the second piston body (9) with the piston rod (19) from the second start position (S2) to a second end position (E2); wherein said valve member means (15) is controlled to manage the second start position (S2) to precede said first end position (El) with an overlap time interval.

* * * * *